US008186455B2

(12) United States Patent
Childers et al.

(10) Patent No.: US 8,186,455 B2
(45) **Date of Patent: *May 29, 2012**

(54) SIMULTANEOUS TUBULAR HANDLING SYSTEM AND METHOD

(75) Inventors: Mark Alan Childers, Naples, FL (US); Brendan William Larkin, Halifax (GB); Harvey Mark Rich, Katy, TX (US); Barry M. Smith, Burton, TX (US)

(73) Assignees: Atwood Oceanics, Inc., Houston, TX (US); Friede Goldman United, Ltd., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/807,356

(22) Filed: Sep. 2, 2010

(65) Prior Publication Data

US 2010/0326672 A1 Dec. 30, 2010

Related U.S. Application Data

(63) Continuation of application No. 11/710,638, filed on Feb. 23, 2007, now Pat. No. 7,802,636.

(51) Int. Cl.
*E21B 19/00* (2006.01)
*E21B 19/20* (2006.01)

(52) U.S. Cl. ..... 175/52; 175/85; 175/57; 175/162; 175/203; 166/77.1; 166/77.51; 166/380

(58) Field of Classification Search ..... 166/77.1, 166/77.51, 338, 339, 341, 343, 345, 358, 166/380; 175/52, 57, 85, 162, 203, 220; 414/22.51, 22.54, 22.55

See application file for complete search history.

(56) References Cited

U.S. PATENT DOCUMENTS

| | | | |
|---|---|---|---|
| 1,776,605 | A | 9/1930 | Tibbetts |
| 1,829,879 | A | 11/1931 | Stephens |
| 2,354,217 | A | 7/1944 | Mullinix et al. |
| 2,381,166 | A | 8/1945 | Hollerith |
| 2,503,516 | A | 4/1950 | Shrewsbury |

(Continued)

FOREIGN PATENT DOCUMENTS

DE 1917451 11/1969

(Continued)

OTHER PUBLICATIONS

National Oilwell Varco website, Nov. 20, 2006 (Horizontal/Vertical Pipehandling, Stand Hand II, V-Door Machine, Pipe Laydown System) © 2006 National Oilwell Varco (10 pages).

(Continued)

*Primary Examiner* — Daniel P Stephenson
*Assistant Examiner* — Robert E Fuller
(74) *Attorney, Agent, or Firm* — Strasburger & Price, LLP

(57) ABSTRACT

A system and method for building and handling oilfield tubular stands while drilling operations are simultaneously and independently occurring with one drilling deck, one derrick, and one rotary system. An offline guided path horizontal to vertical arm lifts and moves in the same plane tubulars stored horizontally on the catwalk and positions the tubulars vertically directly into a preparation hole for assembling and disassembling tubular stands while online drilling operations are simultaneously being conducted. A stand arm lifts and lowers the tubulars into and out of the adjustable preparation hole, and transports the tubulars for storage to an auxiliary tubular racking station in the upper part of the derrick. A bridge racker crane moves tubular stands from the auxiliary tubular racking station to the top drive or another tubular racking station.

20 Claims, 27 Drawing Sheets

U.S. PATENT DOCUMENTS

| | | | |
|---|---|---|---|
| 2,773,605 | A | 12/1956 | De Jarnett |
| 2,808,229 | A | 10/1957 | Bauer et al. |
| 3,001,594 | A | 9/1961 | Suderow |
| 3,038,432 | A | 6/1962 | Goldman |
| 3,191,201 | A | 6/1965 | Richardson et al. |
| 3,279,404 | A | 10/1966 | Richardson et al. |
| 3,404,741 | A | 10/1968 | Gheorghe et al. |
| 3,412,981 | A | 11/1968 | Richardson et al. |
| 3,461,828 | A | 8/1969 | Bielstein |
| 3,477,235 | A | 11/1969 | Branham et al. |
| 3,494,484 | A | 2/1970 | McFadden |
| 3,501,017 | A | 3/1970 | Johnson et al. |
| 3,552,343 | A | 1/1971 | Scott |
| 3,561,811 | A | 2/1971 | Turner, Jr. |
| 3,601,075 | A | 8/1971 | Deslierres |
| 3,602,302 | A | 8/1971 | Kluth |
| 3,615,027 | A | 10/1971 | Ham |
| 3,628,336 | A | 12/1971 | Moore et al. |
| 3,633,771 | A | 1/1972 | Woolslayer et al. |
| 3,682,242 | A | 8/1972 | Brooks et al. |
| 3,734,210 | A | 5/1973 | Wilderman |
| 3,739,736 | A | 6/1973 | Carreau et al. |
| 3,768,663 | A | 10/1973 | Turner et al. |
| 3,774,562 | A | 11/1973 | Dean, III |
| 3,780,883 | A | 12/1973 | Brown |
| 3,799,364 | A | 3/1974 | Kelly et al. |
| 3,802,209 | A | 4/1974 | Weaver |
| 3,822,663 | A | 7/1974 | Boschen, Jr. |
| 3,828,561 | A | 8/1974 | Moore et al. |
| 3,880,105 | A | 4/1975 | Bryant |
| 3,931,782 | A | 1/1976 | Childers et al. |
| 3,937,515 | A | 2/1976 | Langowski |
| 3,976,207 | A | 8/1976 | Schultz |
| 3,986,619 | A | 10/1976 | Woolslayer |
| 3,987,910 | A | 10/1976 | Brunato |
| 4,013,178 | A | 3/1977 | Brown et al. |
| RE29,373 | E | 8/1977 | Boschen, Jr. |
| 4,042,123 | A | 8/1977 | Sheldon et al. |
| 4,067,453 | A | 1/1978 | Moller |
| 4,099,630 | A | 7/1978 | Beck |
| 4,108,255 | A | 8/1978 | Smith |
| 4,126,348 | A | 11/1978 | Palmer |
| 4,139,891 | A | 2/1979 | Sheldon et al. |
| 4,189,255 | A | 2/1980 | Macan et al. |
| 4,195,950 | A | 4/1980 | Goldman |
| 4,208,158 | A | 6/1980 | Davies et al. |
| 4,227,831 | A | 10/1980 | Evans |
| 4,235,566 | A | 11/1980 | Beeman et al. |
| 4,269,543 | A | 5/1981 | Goldman et al. |
| 4,269,554 | A | 5/1981 | Jackson |
| 4,274,778 | A | 6/1981 | Putnam et al. |
| 4,305,686 | A | 12/1981 | Magill |
| 4,334,584 | A | 6/1982 | Magill |
| 4,345,864 | A | 8/1982 | Smith, Jr. et al. |
| 4,351,258 | A | 9/1982 | Ray et al. |
| 4,397,605 | A | 8/1983 | Cowgill et al. |
| 4,403,897 | A | 9/1983 | Willis |
| 4,403,898 | A | 9/1983 | Thompson |
| 4,426,182 | A | 1/1984 | Frias et al. |
| 4,446,807 | A | 5/1984 | Johnson |
| 4,457,250 | A | 7/1984 | Oshima et al. |
| 4,458,768 | A | 7/1984 | Boyadjieff |
| 4,462,733 | A | 7/1984 | Langowski et al. |
| 4,470,468 | A | 9/1984 | Phares |
| 4,470,740 | A | 9/1984 | Frias |
| 4,483,644 | A | 11/1984 | Johnson |
| 4,486,137 | A | 12/1984 | Buckner |
| 4,509,448 | A | 4/1985 | Pease |
| 4,519,728 | A | 5/1985 | Oshima et al. |
| 4,533,055 | A | 8/1985 | Haney |
| 4,571,125 | A | 2/1986 | Oshima et al. |
| 4,601,252 | A | 7/1986 | Wuttudal |
| 4,602,894 | A | 7/1986 | Lorenz |
| 4,604,961 | A | 8/1986 | Ortloff et al. |
| 4,605,077 | A | 8/1986 | Boyadjieff |
| 4,610,315 | A | 9/1986 | Koga et al. |
| 4,621,974 | A | 11/1986 | Krueger |
| 4,629,014 | A | 12/1986 | Swisher et al. |
| 4,658,903 | A | 4/1987 | Tateishi |
| 4,692,081 | A | 9/1987 | Bennett et al. |
| 4,709,766 | A | 12/1987 | Boyadjieff |
| RE32,589 | E | 2/1988 | Goldman et al. |
| 4,725,179 | A | 2/1988 | Woolslayer et al. |
| 4,738,321 | A | 4/1988 | Olivier |
| 4,744,710 | A | 5/1988 | Reed |
| 4,762,185 | A | 8/1988 | Simpson |
| 4,765,401 | A | 8/1988 | Boyadjieff |
| 4,791,997 | A | 12/1988 | Krasnov |
| 4,819,730 | A | 4/1989 | Williford et al. |
| 4,822,230 | A | 4/1989 | Slettedal |
| 4,834,604 | A | 5/1989 | Brittain et al. |
| 4,850,439 | A | 7/1989 | Lund |
| 4,862,973 | A | 9/1989 | Voigts et al. |
| 4,901,805 | A | 2/1990 | Ali-Zade et al. |
| 5,052,860 | A | 10/1991 | Ingle |
| 5,092,712 | A | 3/1992 | Goldman et al. |
| 5,107,940 | A | 4/1992 | Berry |
| 5,181,798 | A | 1/1993 | Gilchrist, Jr. |
| 5,183,122 | A | 2/1993 | Rowbotham et al. |
| 5,248,003 | A | 9/1993 | Song et al. |
| 5,381,750 | A | 1/1995 | Pollack |
| 5,458,454 | A | 10/1995 | Sorokan |
| 5,622,452 | A | 4/1997 | Goldman |
| 5,647,443 | A | 7/1997 | Broeder |
| 5,921,714 | A | 7/1999 | Goldman |
| 5,934,216 | A | 8/1999 | Childers et al. |
| 6,047,781 | A | 4/2000 | Scott et al. |
| 6,048,135 | A | 4/2000 | Williford et al. |
| 6,056,071 | A | 5/2000 | Scott et al. |
| 6,068,069 | A | 5/2000 | Scott et al. |
| 6,085,851 | A | 7/2000 | Scott et al. |
| 6,089,333 | A | 7/2000 | Rise |
| 6,171,027 | B1 | 1/2001 | Blankestijin |
| 6,203,248 | B1 | 3/2001 | Childers et al. |
| 6,220,807 | B1 | 4/2001 | Sorokan |
| 6,231,269 | B1 | 5/2001 | Shear et al. |
| 6,311,788 | B1 | 11/2001 | Weixler |
| 6,343,662 | B2 | 2/2002 | Byrt et al. |
| 6,378,450 | B1 | 4/2002 | Begnaud et al. |
| 6,481,931 | B1 | 11/2002 | Welsh |
| 6,484,806 | B2 | 11/2002 | Childers et al. |
| 6,491,174 | B1 | 12/2002 | Day |
| 6,513,605 | B1 | 2/2003 | Loedden |
| 6,527,493 | B1 | 3/2003 | Kamphorst et al. |
| 6,533,519 | B1 | 3/2003 | Tolmon et al. |
| 6,550,128 | B1 | 4/2003 | Lorenz |
| 6,591,904 | B2 | 7/2003 | Cicognani et al. |
| 6,609,573 | B1 | 8/2003 | Day |
| 6,634,443 | B1 | 10/2003 | Paech et al. |
| 6,688,398 | B2 | 2/2004 | Pietras |
| 6,695,559 | B1 | 2/2004 | Pietras |
| 6,701,861 | B2 | 3/2004 | Key et al. |
| 6,705,414 | B2 | 3/2004 | Simpson et al. |
| 6,766,860 | B2 | 7/2004 | Archibald et al. |
| 6,779,614 | B2 | 8/2004 | Oser |
| 6,821,071 | B2 | 11/2004 | Woolslayer et al. |
| 6,854,520 | B1 | 2/2005 | Robichaux |
| 6,857,483 | B1 | 2/2005 | Dirks et al. |
| 6,860,694 | B2 | 3/2005 | Slettedal |
| 6,926,488 | B1 | 8/2005 | Bolding et al. |
| 6,932,553 | B1 | 8/2005 | Roodenburg et al. |
| 6,969,223 | B2 | 11/2005 | Tolmon et al. |
| 6,976,540 | B2 | 12/2005 | Berry |
| 6,994,505 | B2 | 2/2006 | Hawkins, III |
| 6,997,265 | B2 | 2/2006 | Berry |
| 7,004,259 | B2 | 2/2006 | Pietras |
| 7,021,374 | B2 | 4/2006 | Pietras |
| 7,055,594 | B1 | 6/2006 | Springett et al. |
| 7,083,007 | B2 | 8/2006 | Herst |
| 7,090,035 | B2 | 8/2006 | Lesko |
| 7,096,977 | B2 | 8/2006 | Juhasz et al. |
| 7,128,161 | B2 | 10/2006 | Pietras |
| 7,137,454 | B2 | 11/2006 | Pietras |
| 7,140,443 | B2 | 11/2006 | Beierbach et al. |
| 7,228,913 | B2 | 6/2007 | Folk et al. |
| 7,228,919 | B2 | 6/2007 | Fehres et al. |
| 7,246,983 | B2 | 7/2007 | Zahn et al. |

| | | | |
|---|---|---|---|
| 7,537,424 | B2 | 5/2009 | Innes et al. |
| 7,540,338 | B2 | 6/2009 | Belik |
| 7,802,636 | B2 | 9/2010 | Childers et al. |
| 2003/0049077 | A1 | 3/2003 | Geiger, Jr. et al. |
| 2003/0159853 | A1 | 8/2003 | Archibald et al. |
| 2003/0159854 | A1 | 8/2003 | Simpson et al. |
| 2003/0196791 | A1 | 10/2003 | Dunn et al. |
| 2004/0045703 | A1 | 3/2004 | Hooper |
| 2004/0136813 | A1 | 7/2004 | Pietras |
| 2005/0051343 | A1 | 3/2005 | Pietras et al. |
| 2005/0126792 | A1 | 6/2005 | Berry |
| 2005/0238463 | A1 | 10/2005 | Smith |
| 2005/0269133 | A1 | 12/2005 | Little |
| 2005/0274508 | A1 | 12/2005 | Folk et al. |
| 2006/0081379 | A1 | 4/2006 | Fehres et al. |
| 2006/0104746 | A1 | 5/2006 | Thompson |
| 2006/0113073 | A1 | 6/2006 | Wright et al. |
| 2006/0113075 | A1 | 6/2006 | Springett et al. |
| 2006/0137910 | A1 | 6/2006 | Hamner |
| 2006/0151215 | A1 | 7/2006 | Skogerbo |
| 2007/0017704 | A1 | 1/2007 | Belik |
| 2007/0031215 | A1 | 2/2007 | Belik |
| 2007/0193750 | A1 | 8/2007 | Wright et al. |
| 2008/0101891 | A1 | 5/2008 | Belik |
| 2008/0128167 | A1 | 6/2008 | Eriksen |
| 2008/0136203 | A1 | 6/2008 | Krijnen et al. |
| 2008/0164064 | A1 | 7/2008 | Belik et al. |
| 2008/0202812 | A1 | 8/2008 | Childers et al. |

FOREIGN PATENT DOCUMENTS

| | | | |
|---|---|---|---|
| DE | 2345167 | | 4/1974 |
| EP | 0139237 | A1 | 5/1985 |
| EP | 0234880 | A2 | 9/1987 |
| EP | 0258705 | A2 | 3/1988 |
| EP | 0406986 | A2 | 1/1991 |
| FR | 1379830 | | 10/1963 |
| FR | 2381166 | | 9/1978 |
| FR | 2670742 | A1 | 6/1992 |
| GB | 1214346 | | 12/1970 |
| GB | 1494720 | | 12/1977 |
| GB | 1540544 | | 2/1979 |
| GB | 2041836 | A | 9/1980 |
| GB | 2066758 | A | 7/1981 |
| GB | 2071734 | A | 9/1981 |
| GB | 2094376 | A | 9/1982 |
| GB | 2119427 | A | 11/1983 |
| GB | 2125862 | A | 3/1984 |
| GB | 2137261 | A | 10/1984 |
| GB | 2158132 | A | 11/1985 |
| GB | 2160166 | A | 12/1985 |
| GB | 2160564 | A | 12/1985 |
| GB | 2175629 | A | 12/1986 |
| GB | 2264734 | A | 9/1993 |
| GB | 2264736 | A | 9/1993 |
| GB | 2291664 | A | 1/1996 |
| GB | 2386853 | A | 10/2003 |
| GB | 2386856 | A | 10/2003 |
| JP | 60-146787 | A | 8/1985 |
| JP | 62-80196 | A | 4/1987 |
| JP | 63-134783 | A | 6/1988 |
| JP | 10-169355 | A | 6/1998 |
| NL | 8802980 | A | 12/1988 |
| WO | WO82/01212 | | 4/1982 |
| WO | WO83/01810 | | 5/1983 |
| WO | WO83/03118 | | 9/1983 |
| WO | WO87/07674 | A1 | 12/1987 |
| WO | WO88/01008 | A1 | 2/1988 |
| WO | WO88/08806 | A1 | 11/1988 |
| WO | WO93/09330 | A1 | 5/1993 |
| WO | WO93/15303 | A1 | 8/1993 |
| WO | WO 2008/012580 | A1 | 1/2008 |

OTHER PUBLICATIONS

Aker Kvaemer MH website, Nov. 21, 2006 (Eagle/Eagle Light, Gantry Crane, Pipedeck Pipehandler, Riser Handling Crane, Piperack Crane, Catwalk/Tubular Feeding machine, Bridge Crane Systems, Fingerboards, 2-Arm System), © 2006 Aker Kvaemer MH numbered pp. 34-38 (5 pages).

Smedvig Asia Ltd. of Singapore "CD" (West Alliance 2002 Pipe Handling), referenced in U.S. Appl. No. 11/710,638 specification (one CD provided).

PCT International Searching Authority, International Search Report and Written Opinion, Sep. 23, 2008 for corresponding PCT application claiming priority to present application (7 pages).

OHS Group Limited website, printed on Oct. 16, 2008 (Lightweight Pipehandling System), © 2008 OHS Group Limited (1 page).

OHS Group Limited website, printed on Oct. 15, 2008 (enlarged left drawing of Cite No. E above showing Lightweight Pipehandling System for use with Jack-up and Land Drilling Rigs), © 2008.

OHS Group Limited website, printed on Oct. 16, 2008 (enlarged right drawing of Cite No. E above showing Lightweight Pipehandling System for use with Semisubmersibles and Drill ships), © 2008.

OHS Group Limited website, printed on Oct. 27, 2008 (Derricks, Bridge Crane Racking System, Racking Boards, Monkey Board (Diving Board), HTV (Horizontal to Vertical) Arm, Catwalk Machine, Standbuild Systems, Dual Activity System—Jack-up (DA), Pipehandling Crane, Trojan Pipehandler, DFMA DrillFloor Manipulator Arm, CSB Telescopic Casing Stacking Basket, CTU Conductor Tensioning Unit, Subsea Handling Systems, BOP Handling on Drillships and Semisubmersibles, Riser Management—Horizontal, and Riser Management—Vertical), © 2008 OHS Group Limited (11 pages).

OHS Group Limited website, printed on Oct. 27, 2008 (Reference List with Year, Client/Rig, and Project), © 2008 OHS Group Limited (see 2007 Friede Goldman Atwood Aurora listings) (3 pages).

OHS Group Limited website, printed on Oct. 27, 2008 (Serving the Oilfield and Product Support), © 2008 OHS Group Limited (1 page).

OHS Group Limited website, printed on Oct. 27, 2008 (Home Page), © 2008 OHS Group Limited (1 page).

OHS Group Limited website, printed on Oct. 27, 2008 (OHS Group of Companies), © 2008 OHS Group Limited (2 pages).

Baker, Ron, A Primer of Offshore Operations, 3rd Edition, 1998 © page and p. 55, © 1998 The University of Texas at Austin (2 pages).

Petex, The University of Texas at Austin Petroleum Extension Service, The Rotary Rig and Its Components, © 1979 The University of Texas at Austin (1 page).

UK Intellectual Property Office website, Patents Status Information, Application No. GB0602013.5 titled "Equipment Handling System," filed Feb. 1, 2006 by Brendan Larkin, terminated Feb. 2, 2007, © 2008 Crown (1 page).

UK Intellectual Property Office website, Patents Status Information, Application No. GB0614744.1 titled "Racking Module," filed Jul. 25, 2006 by OHS Group Limited, terminated Oct. 26, 2007, © 2008 Crown (1 page) (priority claimed to this Application in PCT WO 2008/012580 A1 above).

UK Intellectual Property Office website, Patents Status Information, Application No. GB0801293.2 titled "Equipment Handling System," filed Jan. 24, 2008 by OHS Group Limited, © 2008 Crown (1 page).

UK Intellectual Property Office website, Patents Status Information, Application No. GB0801295.7 titled "Compensating Cellar Deck," filed Jan. 24, 2008 by OHS Group Limited, © 2008 Crown (1 page).

UK Intellectual Property Office Searchable Patents Journal Result list for GB08175747 (not yet available) (2 pages).

Family list, 12 family members derived from EP0258705 (1 page).

Family list, 10 family members derived from GB1214346 (1 page).

UK Intellectual Property Office Searchable Patents Journal Result list for GB0817574.7 stating published on Nov. 5, 2008 (one page); Electronic Filing Receipt for GB0817574.7 stating filing date of Sep. 25, 2008 (2 pages) and copy of application received from Brendan Larkin (19 pages) (22 pages total) (see NPL Cite No. "S").

Cover page from Intellectual Property Office of Singapore dated Oct. 22, 2010 (1 page); cover page from Australian Government IP Australia dated Sep. 2, 2010 (1 page); Australian Patent Office Search Report for Application No. SG 200904907-3 (5 pages) (Sep. 2, 2010); Australian Patent Office Written Opinion for Application No. SG 200904907-3 (7 pages) (Sep. 2, 2010) (14 pages total).

Japanese Patent Office, Decision of Grant for Patent, Mailing Number: 062180; Mailing Date: Feb. 1, 2011; Japanese Patent Application 2009-550853 corresponding to US Patent No. 7,802,630, the resulting patent of parent patent application of the present application; see 2A below; Applicants: Atwood Oceanics, Inc. and Friede Goldman United, Ltd. (2 pages).

Intellectual Property Office of Singapore, Acknowledgement and Receipt of Response to Written Opinion malied on Oct. 22, 2010 (2 pages) along with Response (17 pages); Singapore Patent Application No. 200904907-3; corresponding to US Patent No. 7,802,630, the resulting patent of the parent patent application of the present application; see Z below; Applicants: Atwood Oceanics, Inc. and Friede Goldman United, Ltd. (19 pages total).

Intellectual Property Office of Singapore, Search and Examination Report of Singapore Patent Application No. 200904907-3 dated Jul. 7, 2011 from the Australian Patent Office dated Jun. 21, 2011; see Y above (8 pages).

Japanese Patent No. 4690486 (without translation) issued on Feb. 25, 2011 in the name of Atwood Oceanics, Inc. and Friede Goldman United, Ltd. corresponding to US patent No. 7,802,630, the resulting patent of the parent patent application of the present application; published in the Japanese Official Gazette on Jun. 1, 2011; see X above (23 pages).

European Patent Office, Extended European Search Report dated Dec. 27, 2011 corresponding to the present application; Reference MHS/PX208685EP, Application No. 07861817.0-1266/2129862; PCT/US2007023502, Applicants Atwood Oceanics, Inc. and Friede Goldman United, Ltd. (9 pages).

102
104
86
94
96
96
92
92
108
110
88
88
110
100
110
90
90
132
122
130
20
20
128

FIG.12
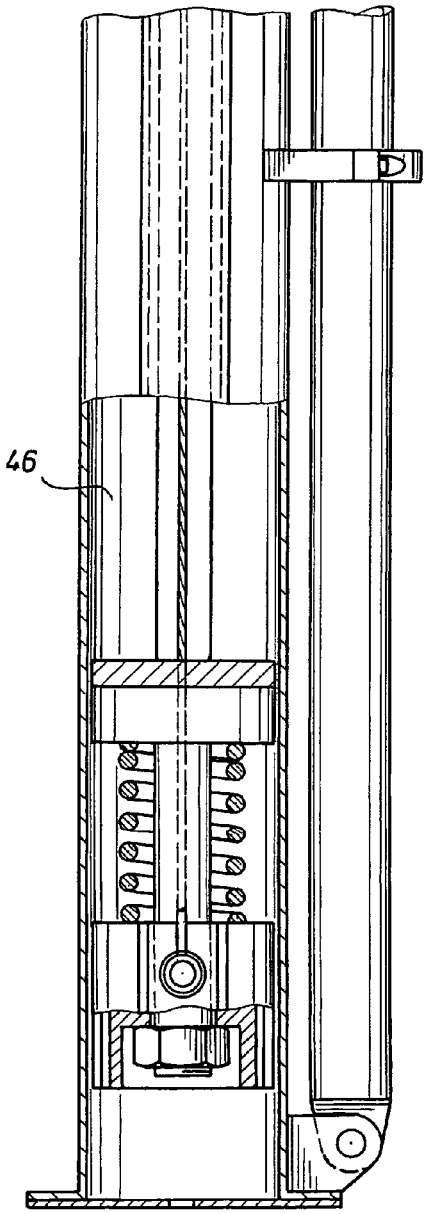
FIG.13
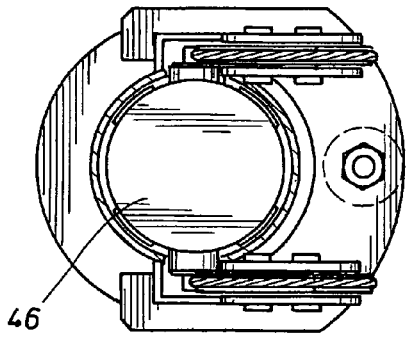
FIG.14
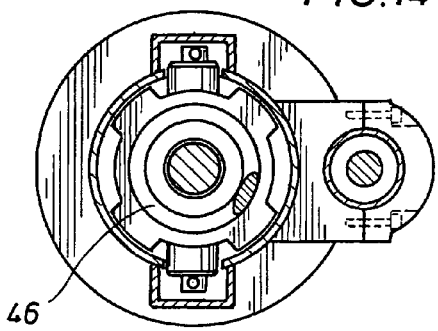
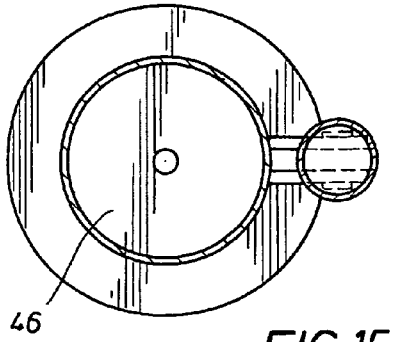
FIG.15

DRILLFLOOR CAB
134
VALVE CONTROL BLOCK
VALVE CONTROL BLOCK
HTV ARM
WINCH
STAND ARM
WINCH
48
65
58
78
VALVE BLOCK
PREPA-RATION HOLE
46
FROM FIG. A
TO FIG. C

SIMULTANEOUS TUBULAR HANDLING SYSTEM AND METHOD

CROSS-REFERENCE TO RELATED APPLICATIONS

This application is a continuation of U.S. application Ser. No. 11/710,638 filed on Feb. 23, 2007, now U.S. Pat. No. 7,802,636, which is hereby incorporated by reference for all purposes in its entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to a novel method and system for transporting, assembling, storing, and disassembling oilfield tubulars in and around a single drilling deck, derrick, and rotary system while drilling operations are simultaneously and independently occurring.

2. Description of the Related Art

Drilling for oil and gas with a rotary drilling rig is being undertaken to increasingly greater depths both offshore and on land. The increase in depth translates into longer drilling time, and increased cost. The cost to operate such rigs is already substantial (rental rates for some offshore rigs can exceed U.S. $400,000 to $500,000 per day). Therefore, any productive operation that can be accomplished independently of drilling operations to save even small amounts of time in the drilling process is economically significant.

The term "tubular" as used herein means all forms of drill pipe (including heavy weight drill pipe, such as HEVI-WATE™ tubulars), casing, drill collars, liner, bottom hole assemblies, and other types of tubulars known in the art. HEVI-WATE™ is a registered trade mark of Smith International, Inc. of Houston, Tex. Drilling operations require frequent stops when a small part of the tubular string extends above the drilling deck. Additional tubulars must be moved from a storage rack and connected with the upper end of the tubular string, which may cause significant delay in drilling. The length of a typical single drill pipe section is 30 feet (about 10 m). A stand is created by connecting together two or more single sections of tubulars. In the past, stands have been assembled or made up with four or five single sections of tubulars. A top drive rotary system is often used in place of the rotary table to turn the drill string, and is now the prevalent method of rotary drilling. One of the benefits of the top drive is that it can drill with pre-assembled tubular stands.

Therefore, the creation and handling of tubular stands independently of the drilling process is a potentially important way to save time and money.

A method and system of handling tubulars simultaneously with drilling operations is described in U.S. Pat. No. 4,850,439 to Lund, the disclosure of which is incorporated herein by reference for all purposes. Lund proposes a preparation hole and an auxiliary hoist for offline stand building. While drilling operations are occurring, Lund proposes a first tubular being lifted in a vertical position when the auxiliary hoist is moved upward so that the tubular is swung from the cable over and then lowered into the preparation hole. Lund proposes that another tubular can then be swung over the first tubular for connection ('439 patent, col. 7, ln. 58 to col. 8, ln. 19). For a third tubular, if the free space below the top of the preparation hole is less than the length of two tubulars, Lund proposes another auxiliary hoist. In such circumstance, the preparation hole must be displaced or tilted from the vertical suspension line of the first auxiliary hoist ('439 patent, col. 9, ln. 58 to col. 10, ln. 46).

Another offline stand building method and system has been proposed by Smedvig Asia Ltd. of Singapore. Smedvig proposes a self erecting offshore tender rig to transfer and erect drilling equipment on a platform. After the drilling equipment is erected on the platform, Smedvig proposes a high line cable system to move tubulars from the tender rig to the platform, a racker crane at the top of the derrick that moves parallel to the drilling deck, and two preparation holes.

Smedvig proposes that while drilling operations are occurring on the platform, a single tubular on the rig can be manually connected at both ends while in horizontal position to the high line cable system. The high line cable system is used to lift and transport the tubular across the water from the rig to the pipe ramp on the platform, where the tubular is manually disconnected. A gripping device connected by cable to a hoist on the racker crane is then manually connected to the upper end of the tubular on the pipe ramp. The tubular is then hoisted in the vertical position, and swung from the cable over the first preparation hole. The tubular is then lowered into the hole, and the gripping device released. The process can be repeated with a second tubular, which can be swung into position in the second preparation hole. The process can be repeated with a third tubular for connection with the first tubular into a double stand. The double stand is then hoisted by the racker crane and lowered for connection with the second tubular for a triple. The completed stand is hoisted up and carried by the racker crane to a vertical tubular storage rack at the top of the derrick. Smedvig also proposes that the first preparation hole can have an adjustable bottom for acceptance of different size tubulars.

Another offline stand building method and system is proposed in U.S. Pat. No. 6,976,540 to Berry, the disclosure of which is incorporated herein by reference for all purposes. Berry proposes, among other things, a load and preparation pipe handling device ("preparation device"), a storage pipe handling device ("storage device"), and tubular storage areas at the top of the derrick. The preparation device includes a vertical truss rotatable about its longitudinal axis. The preparation device includes a gripping device attached at the end of a hoisting cable extending out from the vertical truss. The gripping device is manually attached to one end of a tubular that has been placed near the preparation device on the catwalk or the pipe ramp so that when the cable is retracted back toward the preparation device, the lifted tubular is swung from the cable, similar to the Lund and Smedvig systems.

Berry then proposes that the truss can then swing the vertical tubular in a circular path to a first preparation hole, which has been placed along the path. The preparation device can then lower the first tubular into the first preparation hole. Using two preparation holes, much like the Smedvig system, a stand is assembled. The assembled stand is then lifted vertically by the preparation device to the top of the derrick, and directly exchanged to the storage device, which can either store it or transport it for drilling operations ('540 patent, col. 7, lns. 26-40 and col. 8, his. 30-35).

The oil industry has proposed systems for the online transferring of tubulars from the horizontal position on a pipe rack to the vertical position over the well center. One such system is proposed in U.S. Pat. No. 4,834,604 to Brittian et al., the disclosure of which is incorporated herein by reference for all purposes. Brittian proposes a strongback connected to a boom that is pivotally fixed to a base located adjacent to the rig. The strongback transfers the tubular directly through the V-door from a horizontal position to a vertical position so that a connection between the tubular and the tubular string can be made. Another system is proposed in U.S. Pat. No. 6,220,807 to Sorokan, the disclosure of which is incorporated herein by reference for all purposes. An online pipe handling system is proposed for using a bicep arm assembly pivotally connected to a drilling rig, and a forearm assembly and a gripper head assembly both pivotally connected to the bicep arm assembly. The gripper head assembly grabs the horizontal positioned tubular on the pipe rack adjacent to the rig, and rotates the tubular to a vertical position over the well center.

A horizontal to vertical pipe handling system is proposed in Pub. No. US 2006/0151215 to Skogerbo. Skogerbo discloses an Eagle Light/HTV-Arm, which is distributed by Aker Kvaerner MH of Houston, Tex. The Eagle Light HTV (horizontal to vertical) device is proposed for online transfer of tubulars from a horizontal position at the catwalk to a vertical position in the derrick directly over the well center or into the mousehole. Aker Kvaerner MH also distributes bridge crane systems and storage fingerboards. National Oilwell Varco of Houston, Tex. also manufactures a similar HTV online pipe handling device.

Another online method and apparatus for transferring tubulars between the horizontal position on the pipe rack to the vertical position over the well center is proposed in U.S. Pat. No. 6,705,414 to Simpson et al. Simpson proposes a bucking machine to build tubular stands in the horizontal position on the catwalk. A completed stand is horizontal at a trolley pick-up location, and becomes vertical at the rig floor entry. The stand, clamped to a trolley, is pulled along and up a track with a cable winch. A vertical pipe racking device located in the upper derrick is proposed to transfer the stand directly from the trolley.

The disadvantages of the above tubular handling methods and systems include significant human physical contact with the tubulars and lifting equipment at numerous times and locations, which can result in costly delay or possible injury. The alignment and transfer operations are lengthy and complex. The paths of the tubulars in the offline stand building are not fully restricted, which creates delay and safety hazards. The offline stand building operation may be interrupted when equipment is being used in the online drilling operations. Therefore, a more efficient method and system for handling tubulars that minimizes or eliminates human physical contact with the tubulars and lifting equipment, restricts and controls the path of the tubulars throughout the entire offline operation, requires minimal inefficient movement of the tubulars, and eliminates any potential interruption of the tubular building and drilling process would be desirable.

BRIEF SUMMARY OF THE INVENTION

A system and method for building and handling oilfield tubular stands is disclosed that utilizes a single derrick, drilling deck, and rotary system, and separates the drilling process from the offline stand building process. A guided path horizontal to vertical arm ("HTV") lifts tubulars stored horizontally on the catwalk, and then moves the tubulars in a single vertical plane such that no interference occurs with the drilling process, and multiple articulated motions are reduced. The HTV moves the tubulars between the catwalk and the preparation hole for assembling or disassembling the tubular stands. A stand arm is positioned for lifting and lowering the tubulars into and out of the preparation hole, and transporting the tubulars vertically for storage into an auxiliary tubular racking station in the upper part of the derrick.

A bridge racker crane also mounted in the upper part of the derrick removes tubular stands from the auxiliary tubular racking station and transports them to either the top drive, or to another tubular racking station in the derrick. Using the auxiliary tubular racking station, the offline stand building operation is advantageously uninterrupted when the bridge racker crane is unavailable due to its need to participate in the simultaneously occurring drilling operations.

BRIEF DESCRIPTION OF THE DRAWINGS

A better understanding of the present invention can be obtained with the following detailed descriptions of the various disclosed embodiments in the drawings:

FIG. 12 is an enlarged detailed view of the preparation hole of the present invention as shown in FIG. 11.

FIG. 13 is a section view of the preparation hole taken along line 13-13 of FIG. 10.

FIG. 14 is a section view of the preparation hole taken along line 14-14 of FIG. 10.

FIG. 15 is a section view of the preparation hole taken along line 15-15 of FIG. 10.

DETAILED DESCRIPTION OF THE INVENTION

Figure 1:
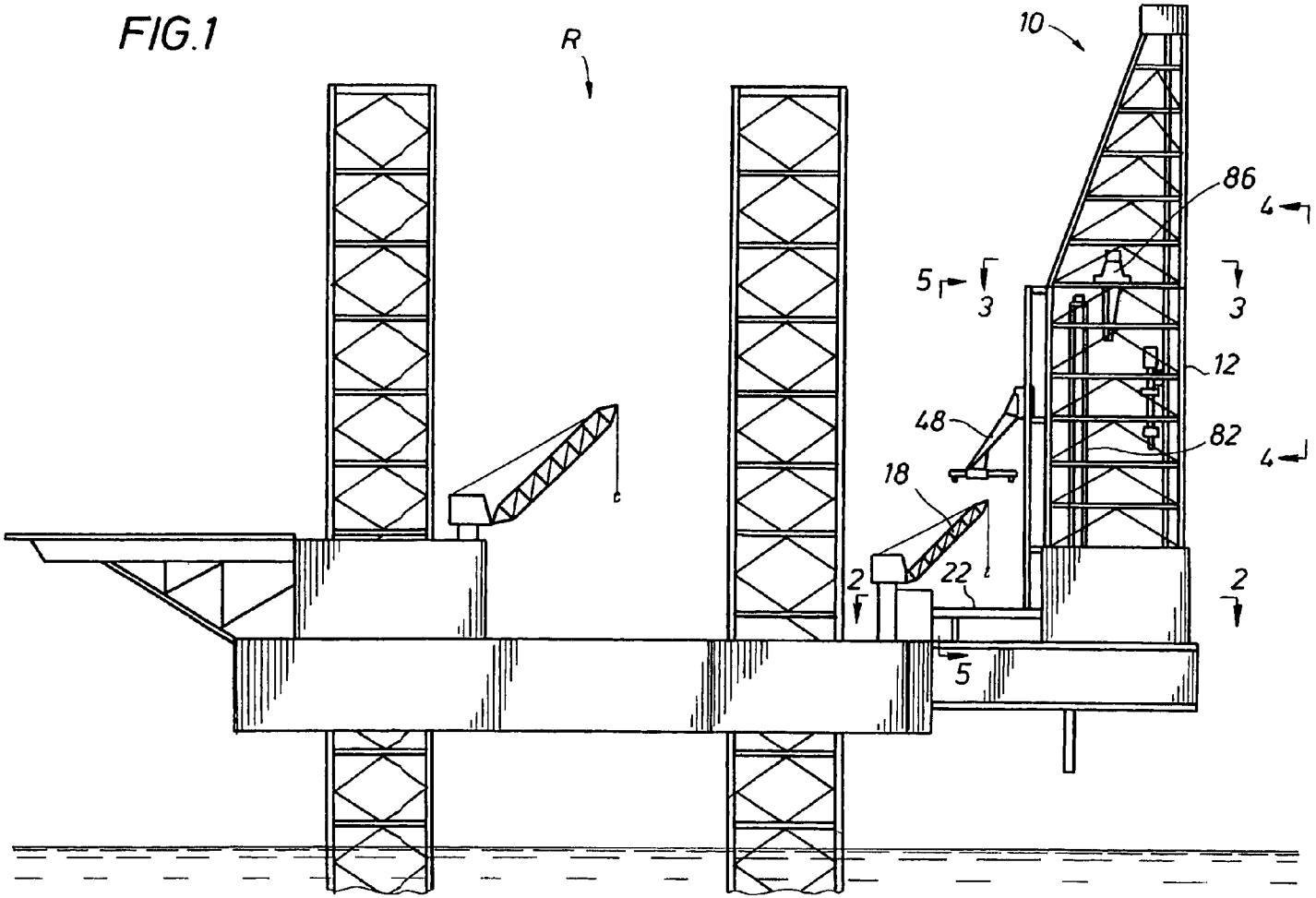
FIG. 1 is an elevational view of the present invention on an exemplary embodiment of a drilling rig.

The present invention involves a system and method for offline building of tubular stands, while drilling operations are simultaneously and independently occurring. As shown in the drawings, this offline stand building comprises moving tubulars from a horizontal position on the catwalk 22 adjacent to the V-door 26 of the derrick 10, lifting and guiding the tubulars in the same plane to a vertical position directly above a preparation hole 46 with a horizontal to vertical arm 48, lowering the vertically positioned tubulars into the preparation hole 46, using a stand arm 58 to move the tubulars in the vertical position for connection into a stand by an auxiliary tubular make up device 56, and transporting the stand vertically to an auxiliary tubular racking station 60 in the upper part of the derrick 10. A bridge racker crane 86 transports the tubular stands from the auxiliary tubular racking station 60 to either the top drive 12, or to first 128 or second 130 tubular racking stations.

An exemplary drilling rig, generally indicated as R, of the invention is shown in FIG. 1. Although an offshore cantilever jack-up rig R is shown, other drilling rig or structure configurations and embodiments are contemplated for use with the invention both for offshore and land drilling. For example, the invention is equally applicable to drilling rigs such as semi submersibles, submersibles, drill ships, barge rigs, platform rigs, and land rigs. Also, although the following is described in terms of oilfield drilling, the disclosed embodiments can also be used in other operating environments for non-petroleum fluids. Further, although the use of a top drive or power swivel is preferred, the invention can also be used with other rotary systems, including, but not limited to, a rotary table.

Figure 2:
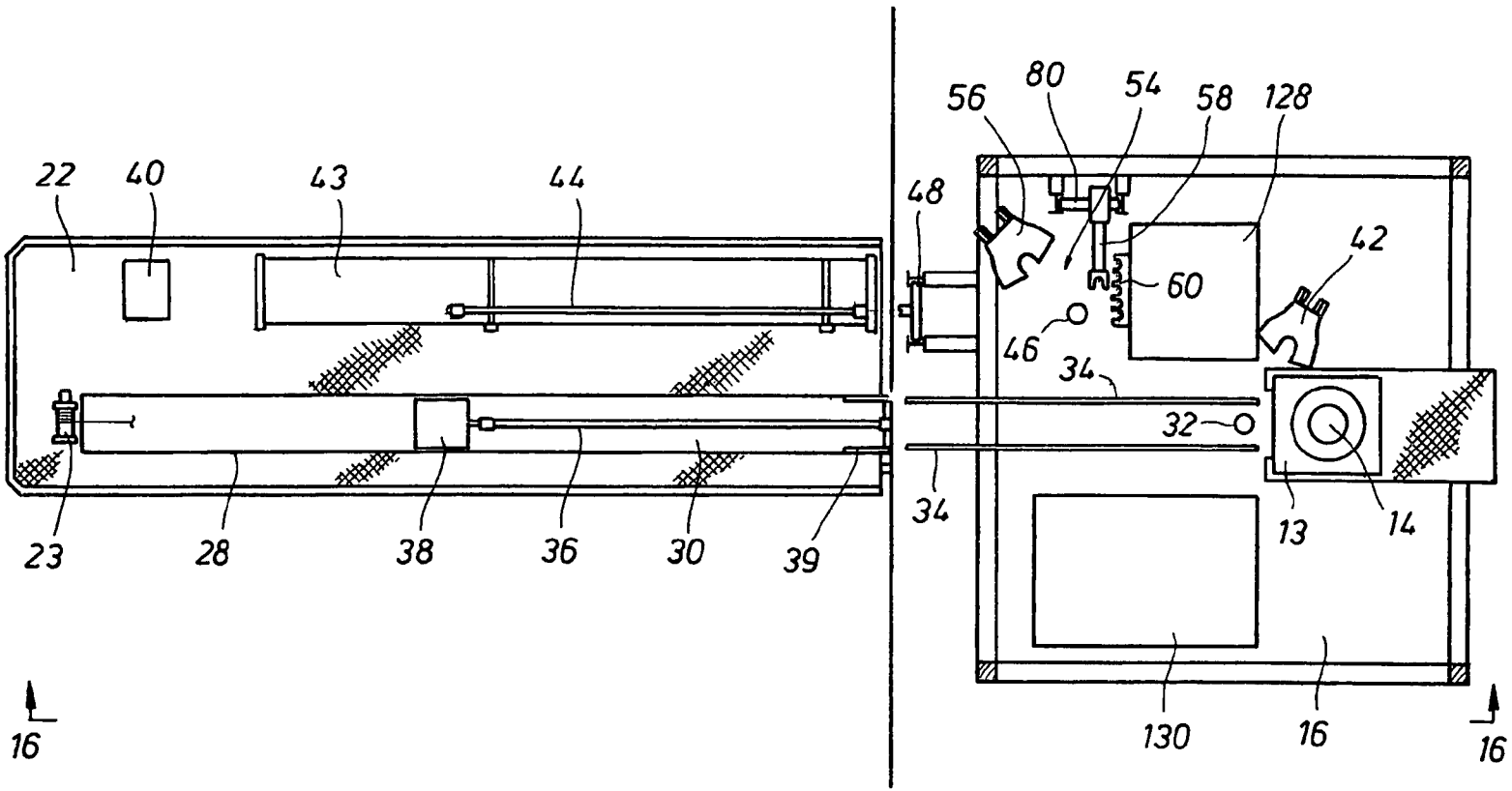
FIG. 2 is a section plan view taken along line 2-2 of FIG. 1 showing the catwalk, the primary tubular advancing station, the primary tubular handling station, and the auxiliary tubular handling station.

Reviewing both FIGS. 1 and 2, a drilling structure or derrick 10 extends above the drilling deck 16. A top drive 12 or power swivel is preferably used to rotate the drill string and bit in the borehole. The top drive 12 is suspended from the traveling block in the conventional manner. A drilling hoist or drawworks is mounted in the derrick 10, as is known by those of ordinary skill in the art. The top drive 12 is aligned vertically with the well center 14 in the drilling deck 16. A deck revolving crane 18 is mounted on the rig R for use in lifting and moving tubulars 20.

Catwalk

Figure 5:
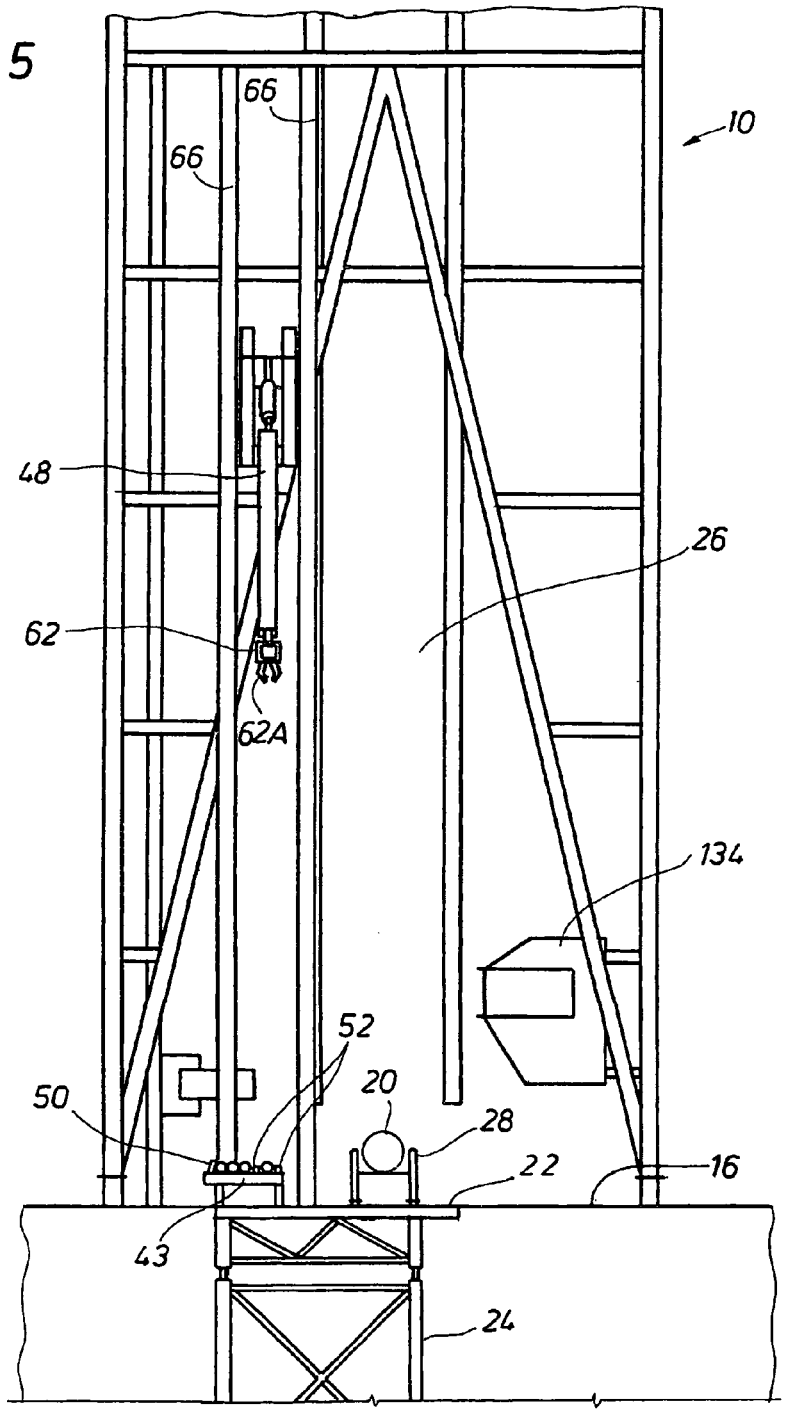
FIG. 5 is a section elevational view taken along line 5-5 of FIG. 1 showing the V-door of the drilling rig and the guided path horizontal to vertical arm ("HTV").

In FIG. 2, the catwalk 22 is supported on the top of the catwalk truss structure 24 (see FIGS. 5 and 17) adjacent to the drilling deck 16. As best shown in FIG. 5, the catwalk 22 is in the same plane as the drilling deck 16, and is adjacent the V-door 26 of the derrick 10. Although a single V-door 26 is shown, it should be understood that derricks may contain more than one V-door, and that the tubulars transported or moved in the present invention may be staged through different V-doors. Turning back to FIG. 2, the online or primary side of the catwalk contains the primary tubular handling station 28, which includes a carriage 30 whose longitudinal axis or centerline is substantially in alignment with the well center 14. A mechanically driven pusher trolley 38 on the carriage 30 is provided to move tubular 36 to and from the well center 14. Although a single catwalk 22 and catwalk truss structure 24 is shown, it should be understood that two different catwalks and supporting structures could be employed to support the primary tubular handling station 28 and the auxiliary tubular handling station, generally indicated at 54, as will be described below. Further, it should be understood that the two different catwalks could be set at different orientations and/or elevations. Although the base 25 (FIG. 17) of the column supporting the catwalk truss structure 24 is shown as fixed, it should be understood that rollers are contemplated at the base so that the catwalk truss structure 24 could be rolled with the drilling deck 16 and derrick 10 if they were also configured to move between well locations.

A primary tubular advancing station 13 comprises at least the well center 14. Also, a drilling hoist, the top drive 12, a tubular make up device 42, and other equipment necessary to advance tubulars into the well center 14 can be provided in the primary tubular advancing station 13. A mousehole 32 is located radially outward from the well center 14, and is positioned substantially on a line between well center 14 and the longitudinal centerline of the carriage 30. The carriage has wheels that run on two parallel rails 34 mounted on the top of the catwalk 22. The rails 34 extend across the drilling deck 16 to a location near the well center 14.

As shown in FIG. 2, a single tubular 36 can be placed on the top of the carriage 30. The carriage 30 transports the tubular 36 along the rails 34 from the primary tubular handling station 28 to the mousehole 32 or well center 14. A pusher trolley 38, whose wheels run on two parallel rails mounted on top of the carriage 30, pushes the tubular 36 toward the well center 14 or mousehole 32. A hydraulic lifter 39 (shown in elevation in FIG. 20) is located at the end of the carriage 30 nearest the well center 14. A section of the top surface of the carriage 30 is hinged so that the hydraulic lifter 39 can raise the unhinged end to elevate the end of the tubular 36 nearest well center 14. The top drive 12 or other similar equipment can then engage the tubular 36 for lifting. When tubular 36 is removed from the well center 14, the pusher trolley 38 can be replaced with a laydown trolley 40 (shown in storage in FIG. 2; and shown in use in FIG. 29) to receive the lower end of the vertical tubular when the carriage 30 is moved near the well center 14. A remotely operable tubular make up device 42 (also known to those skilled in the art as an iron roughneck) is positioned near the well center 14 and the mousehole 32 for use in assembling and disassembling tubular stands.

HTV

As further shown in FIG. 2, the offline or auxiliary side of the catwalk 22 has a pipe rack 43 for the horizontal staging of tubulars. As discussed below, pipe rack 43 is fabricated for the placement of one tubular 44 substantially in alignment with a preparation hole 46. As will be discussed below in detail, the tubular 44 is preferably in alignment with the preparation hole 46 to facilitate the guided path movement of the tubular by the horizontal to vertical arm 48 (referred to as HTV). The pipe rack 43 preferably stores approximately 5 auxiliary tubulars. Any type of tubular can be placed in the area for pick up by the HTV 48. As best shown in elevation view in FIG. 5, the pipe rack 43 has a hydraulically operated indexing arm assembly 50 that rolls the tubulars toward the pick up location for the HTV 48. Hydraulically activated separators 52 isolate the one tubular 44 that is to be gripped by the HTV 48. The pipe rack 43 is also indexed or marked so that the operator of the deck crane 18 can place the tubulars in a consistent location. The deck crane 18 is used to place tubulars on both sides of the catwalk 22 (see FIG. 18). Tubulars on the carriage 30 and on the pipe rack 43 are both in the horizontal position, are parallel to each other, and have access to the V-door 26 of the derrick 10.

Figure 2A:
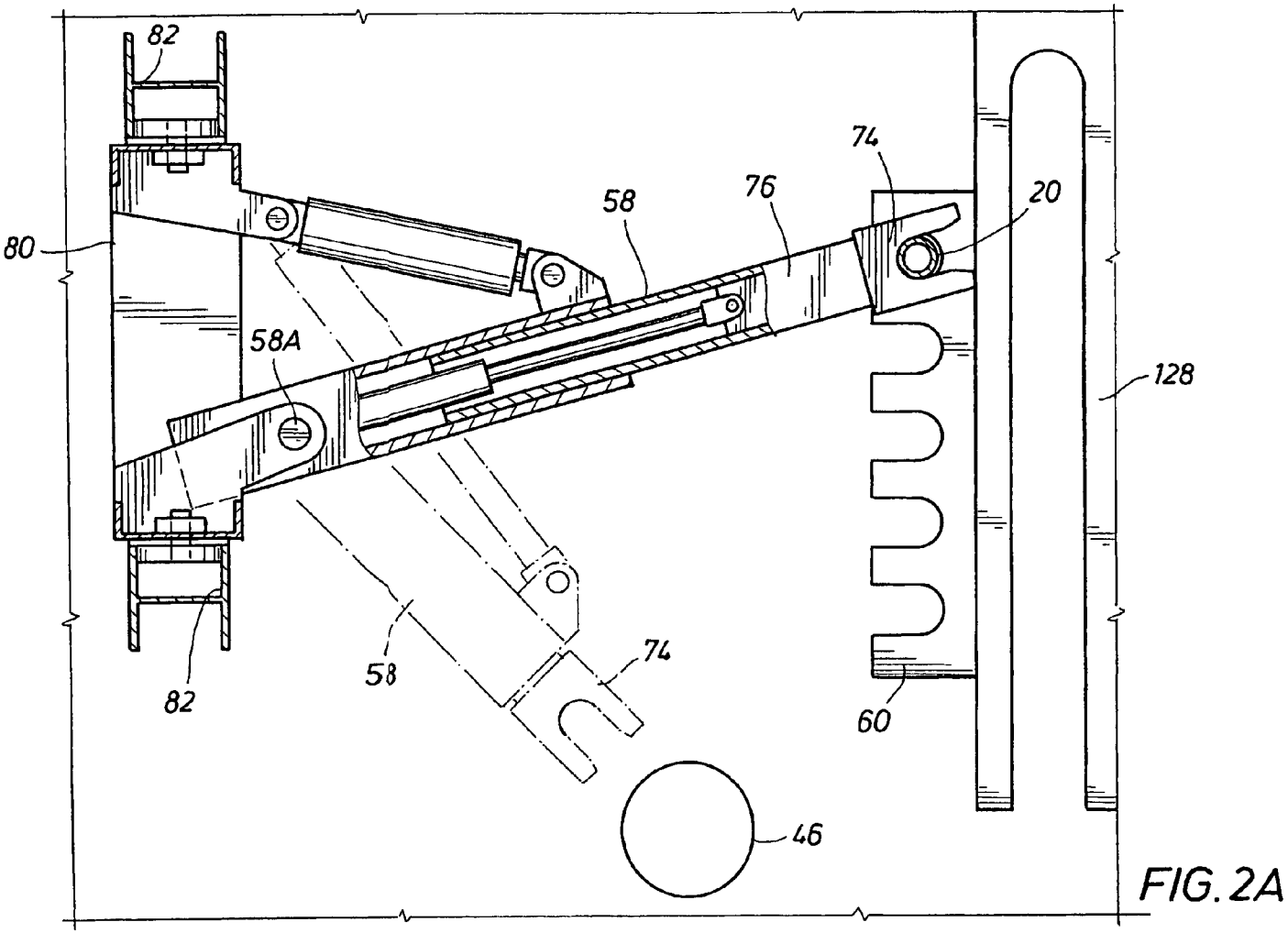
FIG. 2A is a plan view showing the stand arm, the preparation hole, and the auxiliary tubular racking station in alternative locations relative to each other as compared with FIG. 2 and the other drawings.
Figures 6, 7:
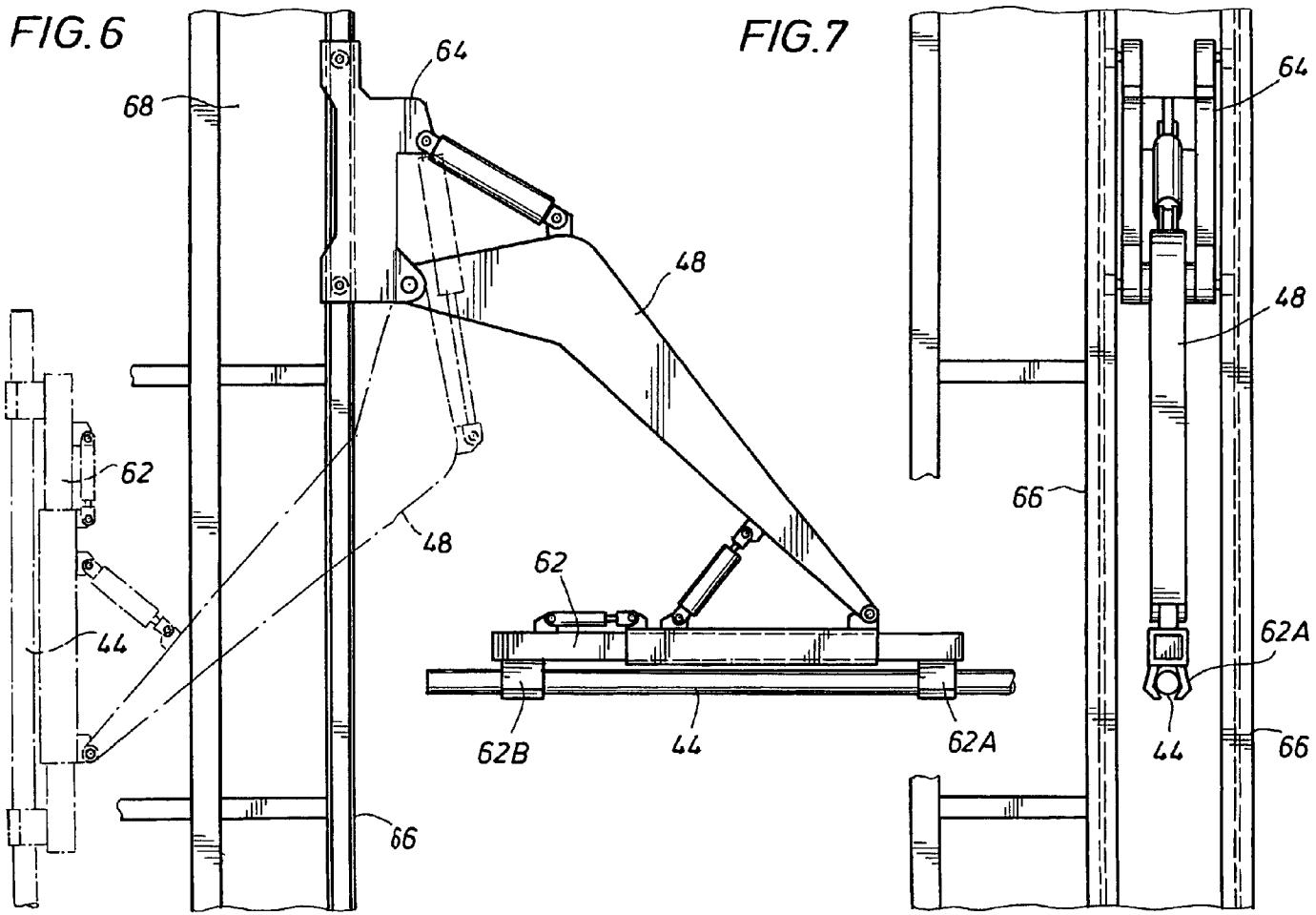
FIG. 6 is an enlarged elevational view of the HTV with a tubular shown in the horizontal position in solid line and in the vertical position in phantom view.
FIG. 7 is an elevational view of the HTV, rotated 90° about the vertical axis from FIG. 6, with the tubular in the horizontal position.

An auxiliary tubular handling station, generally indicated as 54, is shown in FIG. 2. The auxiliary tubular handling station 54 comprises at least a stand arm or pick up arm 58. Also, the HTV 48 and the preparation hole 46 and an auxiliary tubular make up device 56 (e.g. iron roughneck) can be provided in and/or adjacent to the auxiliary tubular handling station 54. FIG. 2A illustrates the capability of the stand arm 58 to grip tubulars in either, when lowered, the preparation hole 46 on the drilling deck 16 (shown in phantom view), or, when raised, in the auxiliary tubular racking station 60 mounted up in the derrick. FIG. 2A shows an alternative configuration to that shown in FIG. 2 and the other drawings of the location of the stand arm 58 in relation to the auxiliary tubular racking 60. FIGS. 5 and 7 show the auxiliary tubular handling device or HTV 48 as seen from the catwalk 22. FIG. 6 best shows the HTV 48 gripper assembly 62 having grippers 62A or 62B that grips a tubular 44 as shown in FIGS. 6 and 7. The HTV 48 has a single arm. The HTV 48 moves vertically and perpendicular with the drilling deck 16 using a hoist 65 (see FIG. 16) driven trolley assembly 64 that is mounted to two rails 66 attached to a substantially vertical frame 68 connected to the derrick 10. The hoist can also be mounted on the drilling deck 16. It is contemplated that a rack and pinion or a hydraulic cylinders mechanism could be used in lieu of a hoist driven system. The HTV 48 is fabricated so that it can grip a substantially horizontal tubular from the pipe rack 43 on the offline side of the catwalk 22, lift the tubular vertically from the catwalk 22 while keeping the tubular substantially horizontal to a second horizontal position (shown in FIG. 17), and thereafter guide the tubular in the same plane 90° so that the tubular 72 is in vertical alignment with the preparation hole 46 (shown in FIG. 18). The size, shape, and configuration of the HTV is exemplary and illustrative only, and other sizes, shapes, and configurations can be used to create the same guided movement of the tubular.

Preparation Hole

The preparation hole 46 is shown in detail in FIGS. 10 to 15. The depth of the preparation hole 46 can be adjusted for the different lengths of tubulars placed in it. The variable length is necessary to accommodate, for example, drill pipe (27 to 32 feet), and casing (37 to 43 feet). The depth of the preparation hole 46 can be adjusted so that there is enough of the tubular extending above the drilling deck 16 to allow the auxiliary tubular make up device 56 to grip the tubular in the hole 46 and connect or disconnect it with another tubular above the hole 46. The HTV 48 can also set the lower end of a tubular in the preparation hole 46, and the tubular can be independently advanced into the hole, as shown in FIGS. 10 to 15, after it is released by the HTV. The preparation hole 46 can hold smaller tubulars, such as completion tubing (for example 2 ⅞ inch OD), and larger tubulars, such as casing (for example 9 ⅝ inch OD). Since different diameter tubulars will be placed in the preparation hole 46, it is contemplated that the preparation hole 46 could include a centralizer to center the tubular so that the vertical centerline of the tubular remains in vertical alignment with the vertical centerline of the preparation hole 46. The centralizer could comprise an inflatable member or hydraulically radially inwardly driven members to center the tubular.

Stand Arm

Figure 20:
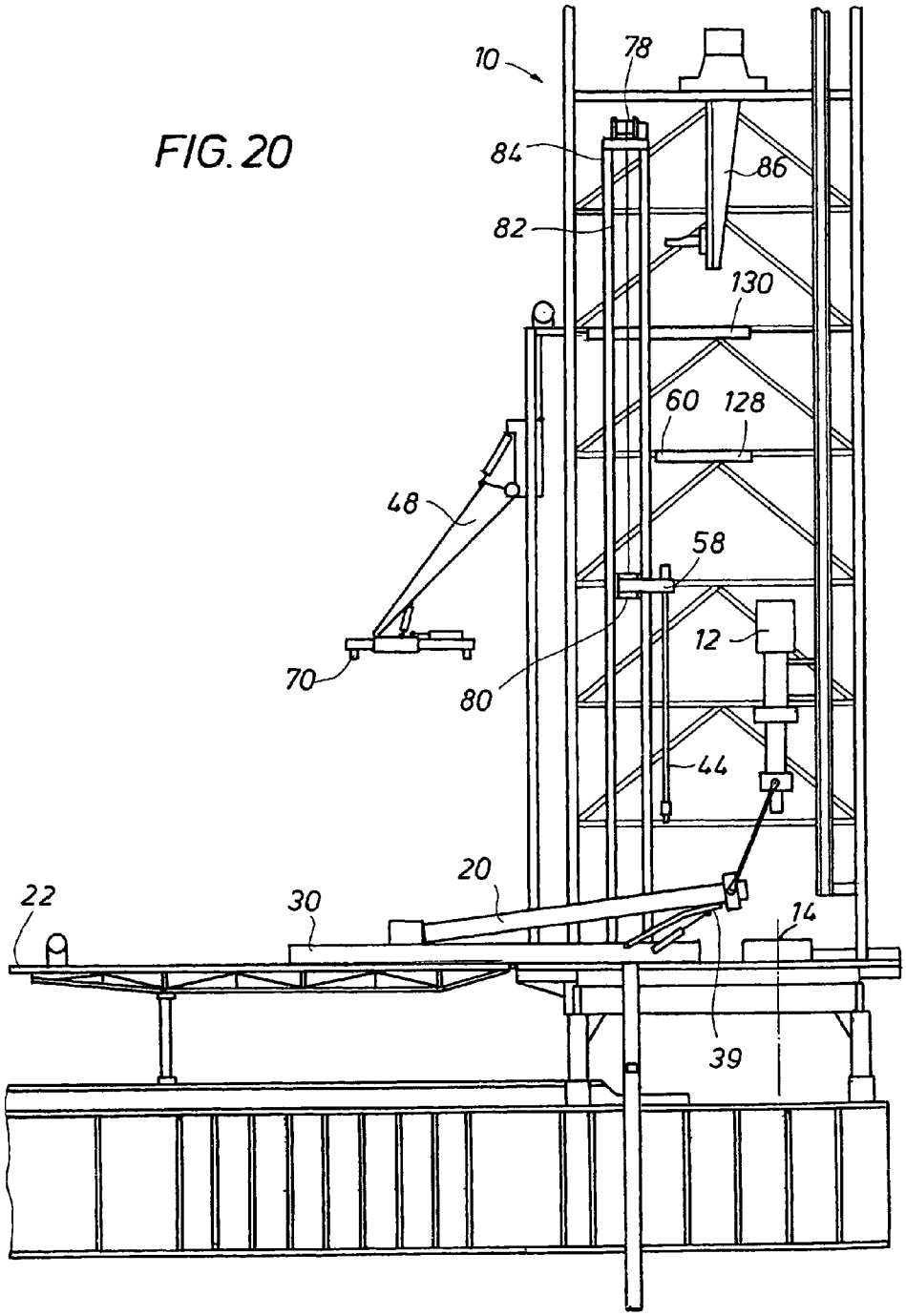
FIG. 20 is a view similar to FIG. 16 with the HTV raised, and the stand arm lifting the drill pipe section up and out of alignment with the preparation hole while the casing section, moved by the online carriage towards well center, is simultaneously being gripped by the top drive.

Returning to FIGS. 2 and 2A, the stand arm 58 can pick up a single tubular 20 or stands of two or more tubulars. Preferably the stand arm 58 has a gripper head 74 attached to the end of a telescoping arm 76. The gripper head 74 allows tubulars to be rotated while within its grip, as the tubulars are threaded. The pick up point for a tubular is slightly below the "upset" location on the tubular where the outside diameter (OD) of the tubular changes diameter. As best shown in FIG. 20, the stand arm 58 is mounted to a hoist 78 driven trolley assembly 80 (see plan view in FIG. 2A) that moves vertically and perpendicular with the drilling deck 16. The trolley assembly travels on two vertical rails 82 that are attached to a substantially vertical frame 84 mounted to the derrick 10. Although the hoist is shown on top of the vertical frame 84, it should be understood that the hoist could also be mounted on the drilling deck 16. Although a hoist driven system is shown, it should also be understood that a rack and pinion or hydraulic cylinders drive system could be used instead. As shown in FIG. 2, the stand arm 58 could move in a horizontal plane along the longitudinal axis of the trolley assembly 80, which is parallel to the line between the tubular 44 and the preparation hole 46. A telescoping arm 76 (see FIG. 2A) could be used to allow the stand arm 58 to extend and retract in a horizontal plane perpendicular to the line between the tubular 44 and the preparation hole 46. While the stand arm 58, as shown in FIG. 2, does not rotate about a vertical axis, the alternate embodiment stand arm 58, as shown in FIG. 2A, can pivot about pivot pin 58A in a horizontal plane about a vertical axis. In either embodiment, when the stand arm is in its lowest position near the drilling deck 16, the telescoping arm 76 can extend out to grip with the head 74 tubulars extending out of the preparation hole 46. The stand arm 58 is fabricated to lift a tubular or stand out of the preparation hole 46, and thereafter retract and either move or rotate so as to hold the tubular or stand in a substantially vertical position in the area of the auxiliary tubular handling station 54 but out of the path of a tubular moved by the HTV to the preparation hole 46. The stand arm 58 is also fabricated to reverse the steps for controlled movement of a tubular or stand from the auxiliary tubular racking station 60 to the preparation hole 46 for disconnection by the auxiliary tubular make up device 56. The stand arm 58 length and load carrying ability is adjustable for any combination of different sized tubulars. The stand arm 58 is further capable of controlled movement of a tubular stand in a vertical position up the derrick 10, and placing it in the auxiliary tubular racking station 60.

Bridge Racker Crane

Figure 3:
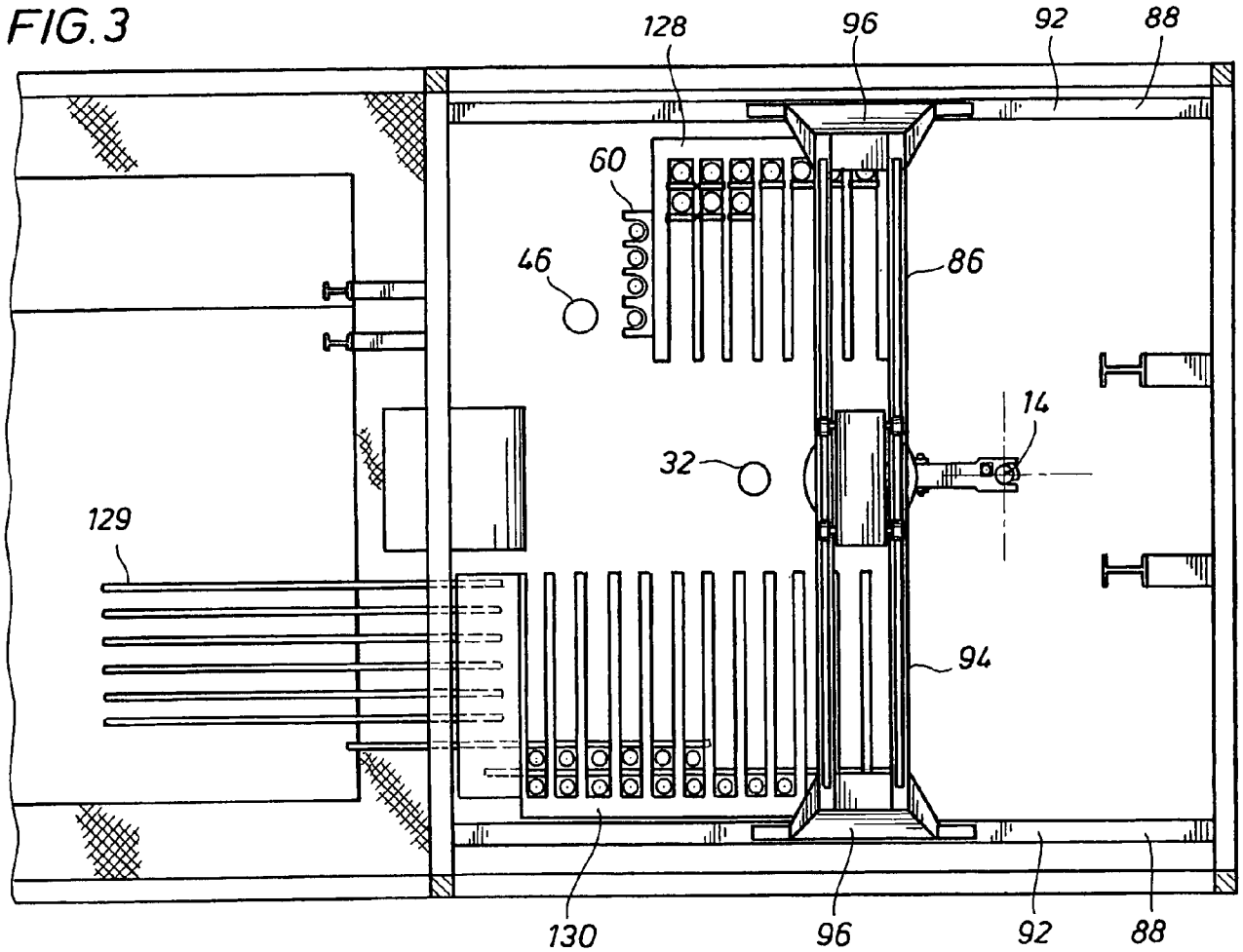
FIG. 3 is a section plan view taken along line 3-3 of FIG. 1 showing the bridge racker crane, the auxiliary tubular racking station, and the first and second tubular racking stations.
Figure 4:
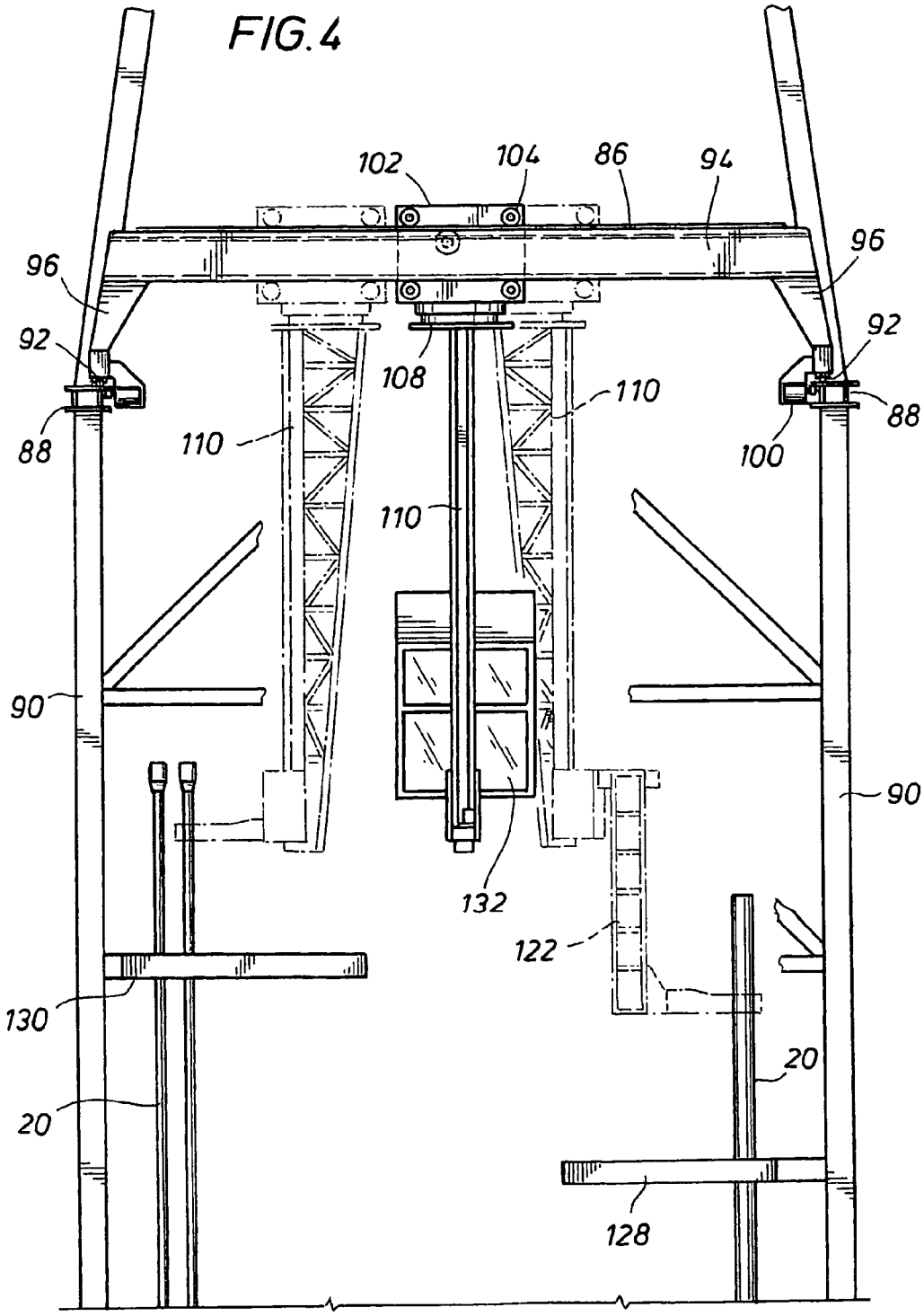
FIG. 4 is a section elevational view taken along line 4-4 of FIG. 1 showing the bridge racker crane, the first and second tubular racking stations, and in phantom view the bridge racker crane in different positions with and without the casing frame.
Figures 8, 9:
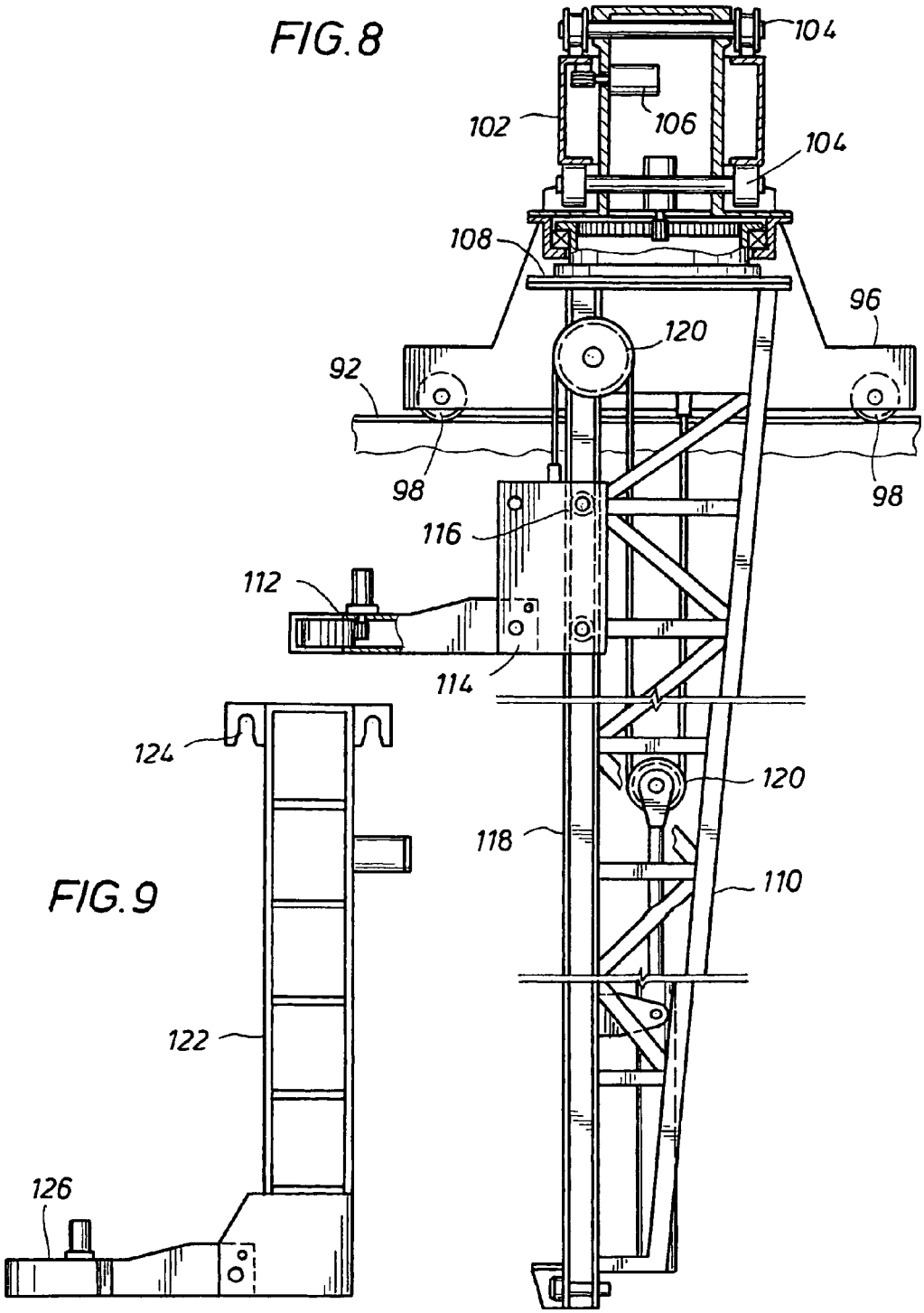
FIG. 8 is an enlarged detailed elevational view of the bridge racker crane of the present invention.
FIG. 9 is a detailed elevational view of an attachment for the bridge racker crane to handle casing sections or stands.
Figure 10:
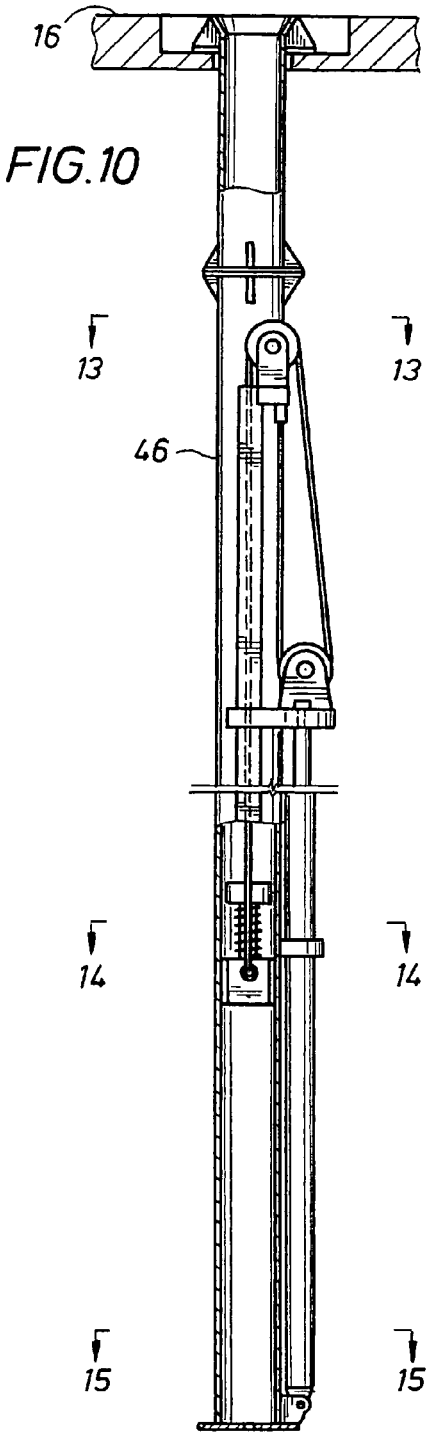
FIG. 10 is an elevational view of the preparation hole shown in broken view with portions of the pulley cable shown in phantom view.
Figure 11:
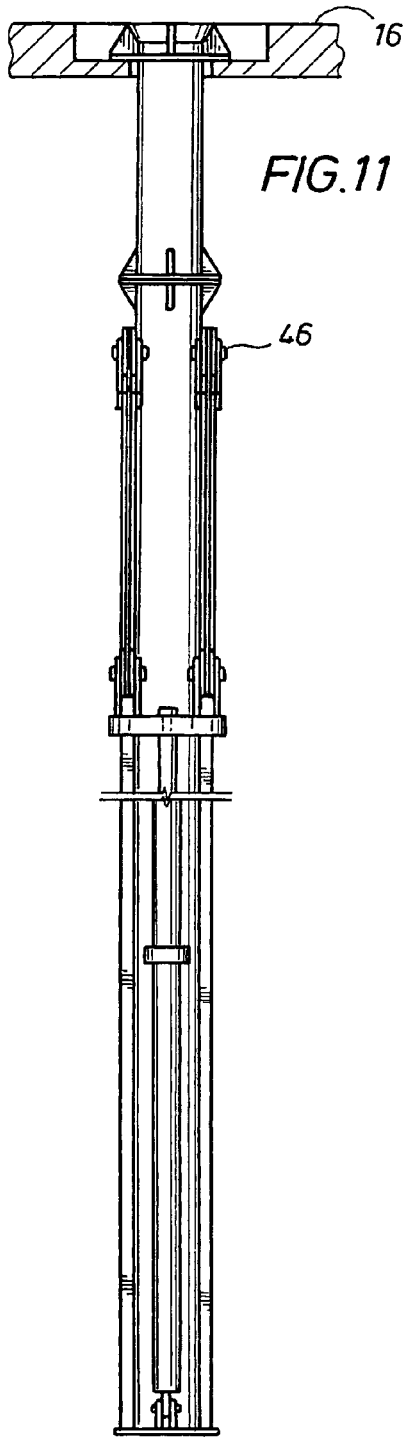
FIG. 11 is an elevational view of the preparation hole, rotated 90° about the vertical axis from FIG. 10.

As shown in FIGS. 3 and 4, a bridge racker crane 86 is mounted in the upper part of the derrick 10. Two parallel horizontal support beams 88 for the bridge crane 86 are attached in the upper part of the derrick to the derrick uprights 90. Each support beam 88 is preferably positioned an equal distance from the well center 14, so that the center of the bridge crane 86 can be moved in vertical alignment with the well center 14. Rails 92 are mounted to the top of each of the support beams 88. The crane bridge beam 94 spans horizontal and perpendicular between the two support beams 88. The crane bridge beam carriage assemblies 96 (see FIGS. 4 and 8) have wheels 98 attached to and resting on their respective rails 92. As illustrated in FIG. 4, at least one end carriage assembly has a rack and pinion drive unit 100 to move the bridge beam 94 along the rails 92. A cross travel unit 102, as shown in FIG. 4 and in section view in FIG. 8, is mounted on the bridge beam 94. The cross travel unit 102 has wheels 104 that that run on the bridge beam 94, and a rack and pinion drive unit 106 to move the cross travel unit 102 along the length of the bridge beam 94. A slewing ring 108 under the cross travel unit 102 connects with a mast and cylinder guard truss 110 mounted under the cross travel unit 102. The slewing ring 108 allows the truss 110 to rotate about a vertical axis, as best shown in FIG. 4. As shown in FIG. 8, a grip head assembly 112 is mounted to the truss 110 by a trolley assembly 114. The wheels 116 of the trolley assembly 114 run on vertical rails 118 mounted on the truss 110. The trolley assembly 114 is raised and lowered with a system of pulleys 120. Although a system of pulleys 120 is shown, it should be understood that other systems are contemplated, such as rack and pinion and hydraulic cylinders.

Due to the difference in length between casing and drill pipe, casing stands typically consist of two tubulars, whereas drill pipe stands typically consist of three tubulars. As shown in FIG. 9, when casing is being handled, a casing frame 122 can be attached to the trolley assembly 114 mounted on the truss 110. The casing frame 122 is attached to the trolley assembly 114 at the storage hanger points 124 of the casing frame 122. The casing frame 122 has a casing grip head 126 that can be used to grip casing in the vertical position at the location of the upset or collar.

Tubular Racking Stations

Figure 30A:
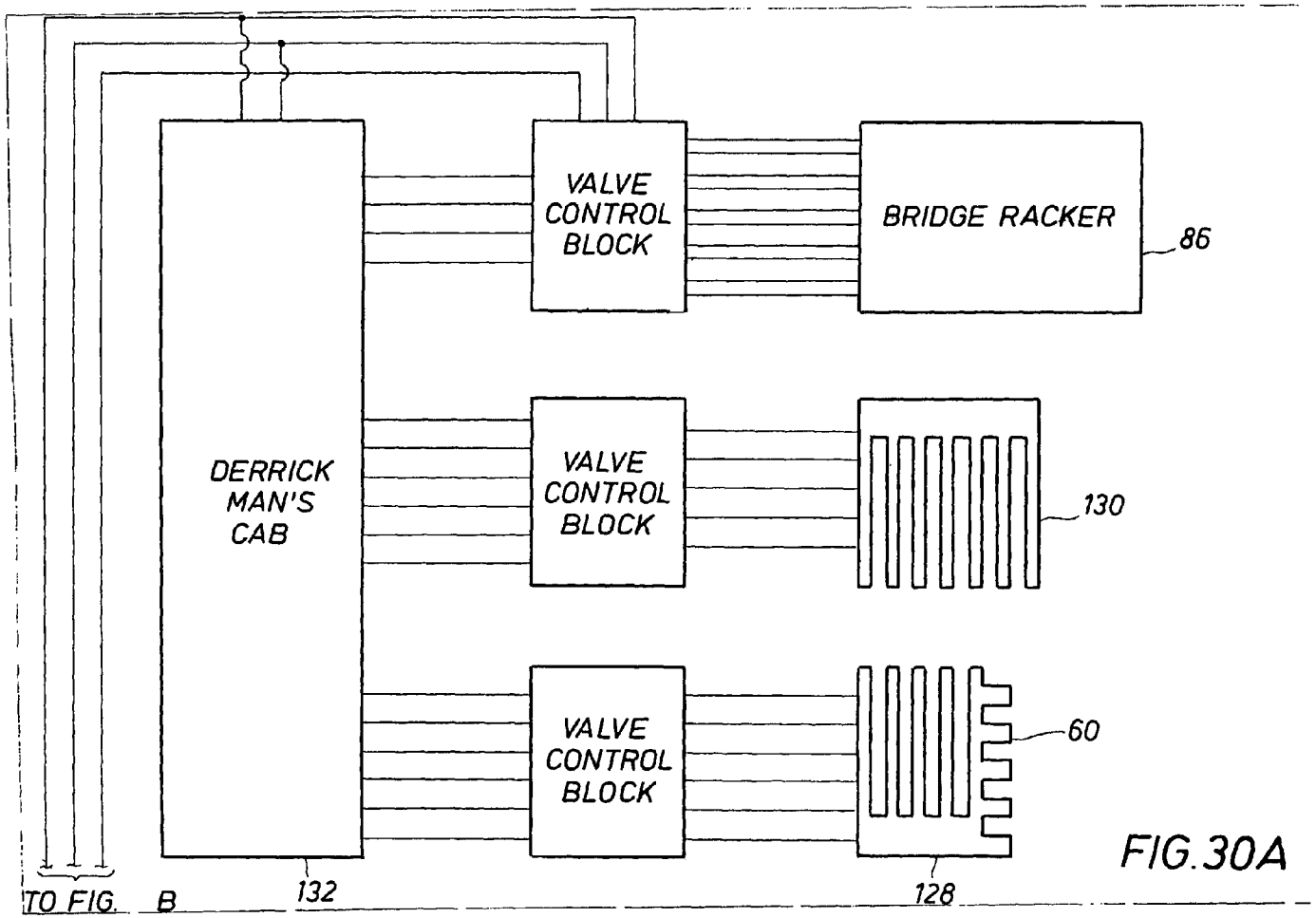
FIGS. 30A, 30B AND 30C illustrate the circuitry for the simultaneous pipe handling system of the present invention.
Figure 30B:
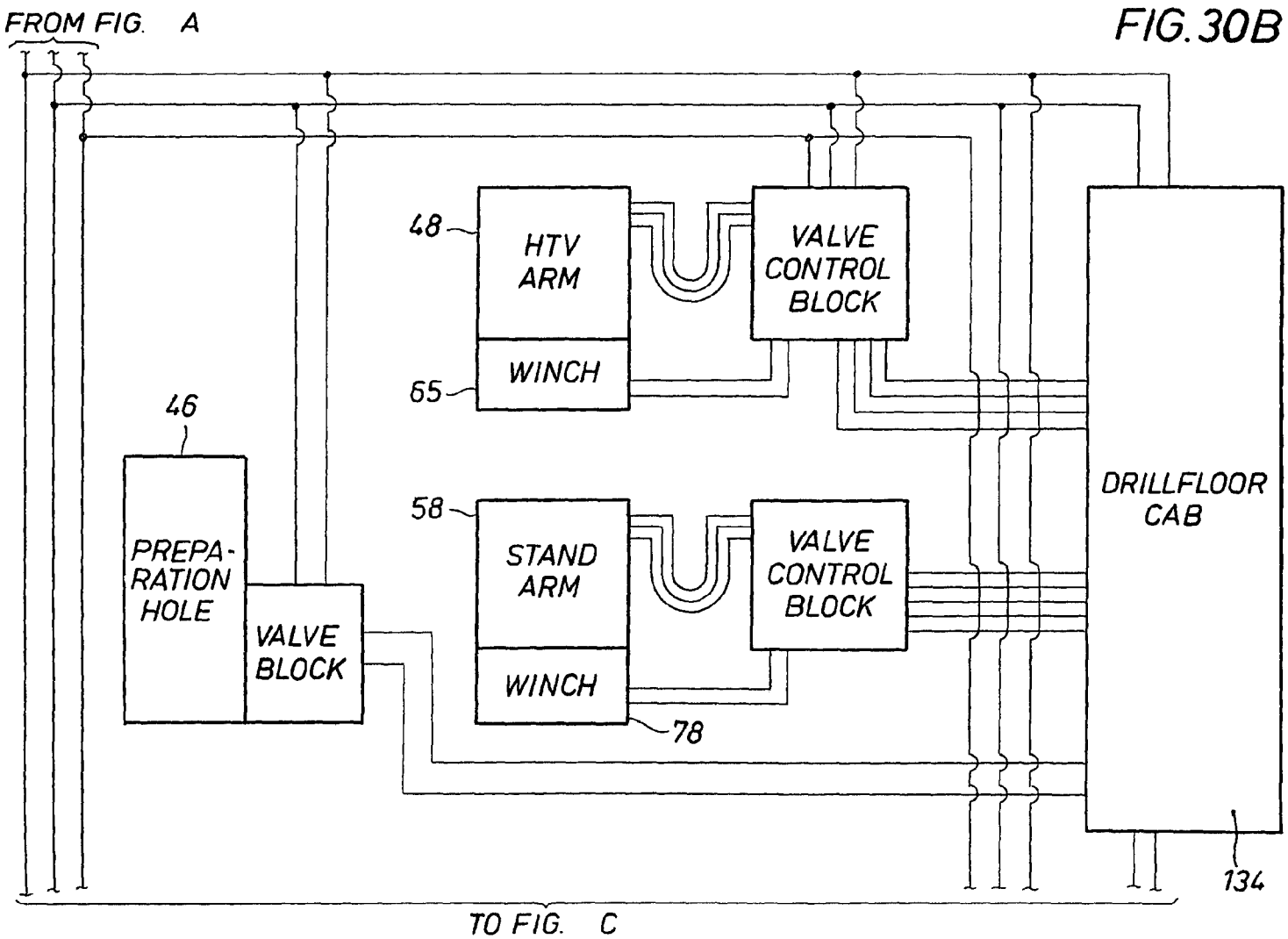
Figure 30C:
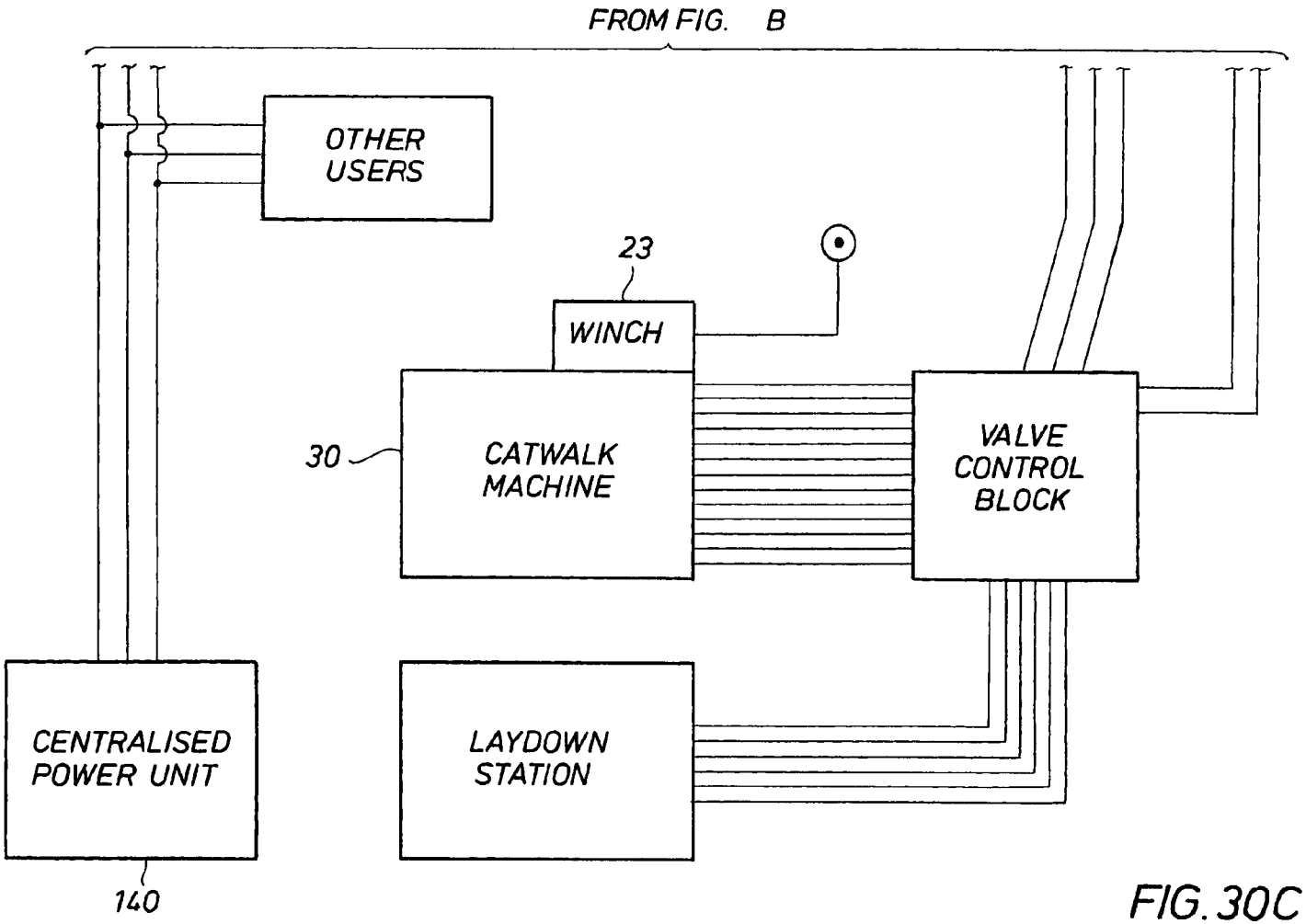

As shown in FIGS. 3 and 4, three tubular racking stations are mounted in the upper derrick 10 for storage of tubular stands. The first tubular or casing racking station 128 (shown in elevation in FIG. 4) is set at a lower elevation than the second tubular or drill pipe racking station 130. It is anticipated that the shorter tubular stands, such as casing, will be placed in the first tubular racking station 128, whereas longer stands, such as drill pipe, will be placed in the second tubular racking station 130. Both first and second tubular racking stations (128, 130) are conventional finger boards as understood by those skilled in the art. Remotely operable spears or lances 129 are used to hold the tubulars into position while in storage. When the derrick arrangement precludes the spears or lances 129 extending beyond the envelope or footprint of the derrick 10, conventional fingers, such as used on the first 128 or second 130 tubular racking stations, are contemplated. The auxiliary racking station 60 is mounted below the first tubular racking station 128. The bridge racker crane 86 is able to travel over the area of all three racking stations, as well as the well center 14. It can maneuver tubulars into and out of all three tubular racking stations. The bridge crane can also move tubulars between any of the three tubular racking stations and the top drive 12. A derrick man's control station cab 132 (as shown in FIG. 4) is mounted in the upper derrick 10 for control of the bridge crane 86, the auxiliary tubular racking station 60, and the first 128 and second 130 tubular racking stations. The block control diagram for the derrick man's control station cab 132 is shown in FIG. 30A. A drill floor control station cab 134 is mounted on the derrick 10 above the drilling deck 16 (as shown in FIG. 5) for control of the HTV 48, stand arm 58, preparation hole 46, and carriage 30. The block control diagram for the drill floor control station cab 134 is shown in FIG. 30B. FIG. 30C shows the connection of both control stations with the centralized power unit 140.

Method of Use

Offline

The present invention is also directed to a method of offline stand building while drilling operations are simultaneously and independently occurring. It should be understood that while the offline stand building operation occurs as described below, drilling operations may be simultaneously occurring. For example, while offline stand building is occurring, the bridge racker crane 86 can remove completed tubular stands from any of these three tubular racking stations 60, 128 or 130 and carry them to the top drive 12 for drilling or placement in the well center 14. Alternatively, single horizontal tubulars, such as tubular 36, can be advanced from the carriage 30 directly to a location near the well center 14. The top drive 12 can attach to the end of a single tubular 20 (FIG. 20), lift it into the vertical position (FIG. 21), and move it through or stab it into the tubular extending above the well center 14. The top drive 12 can be engaged for drilling, and the process repeated when another tubular is needed.

Figure 16:
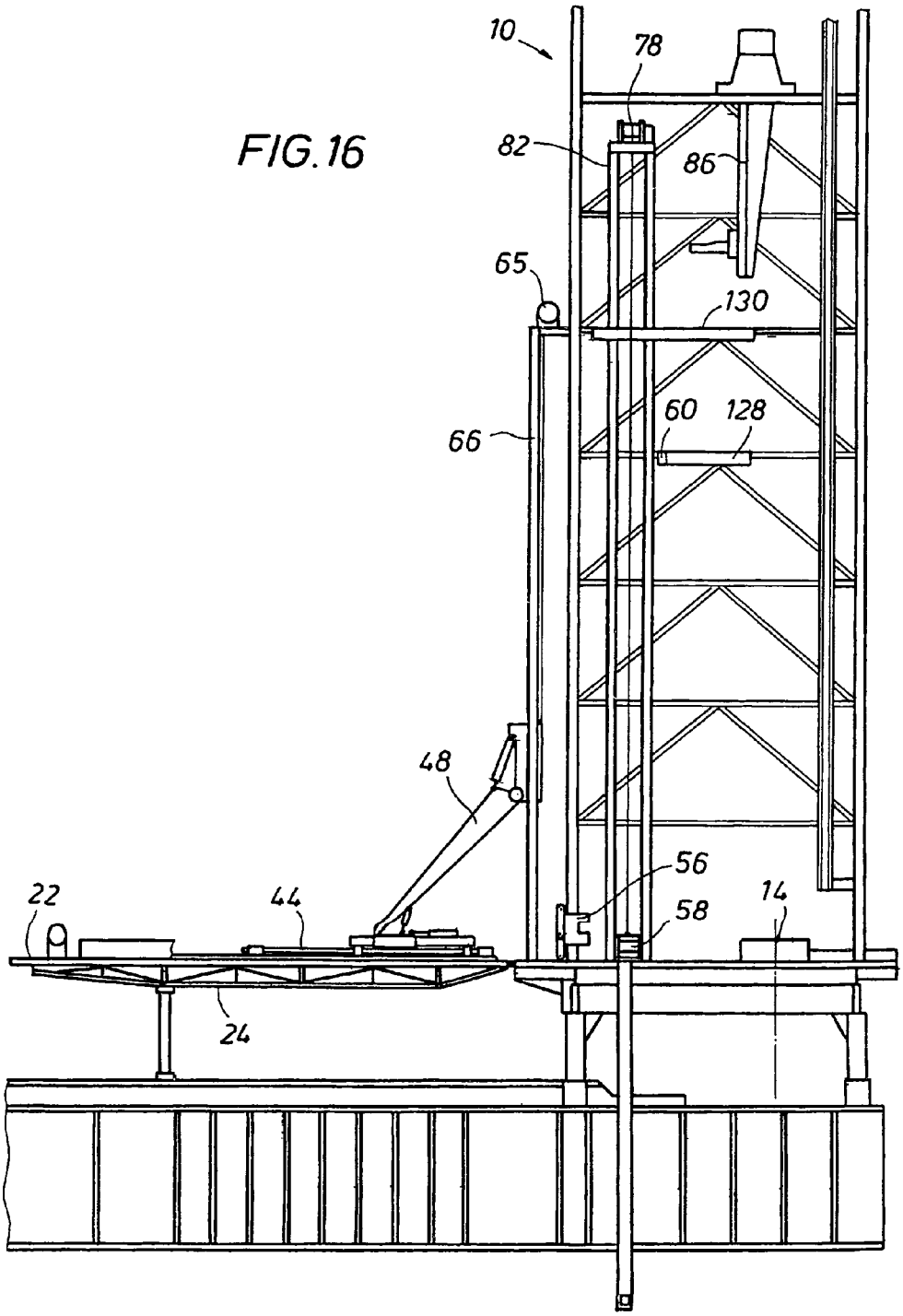
FIG. 16 is an elevation view taken along line 16-16 of FIG. 2, illustrating the HTV lowered for gripping a tubular in the first horizontal position.
Figure 17:
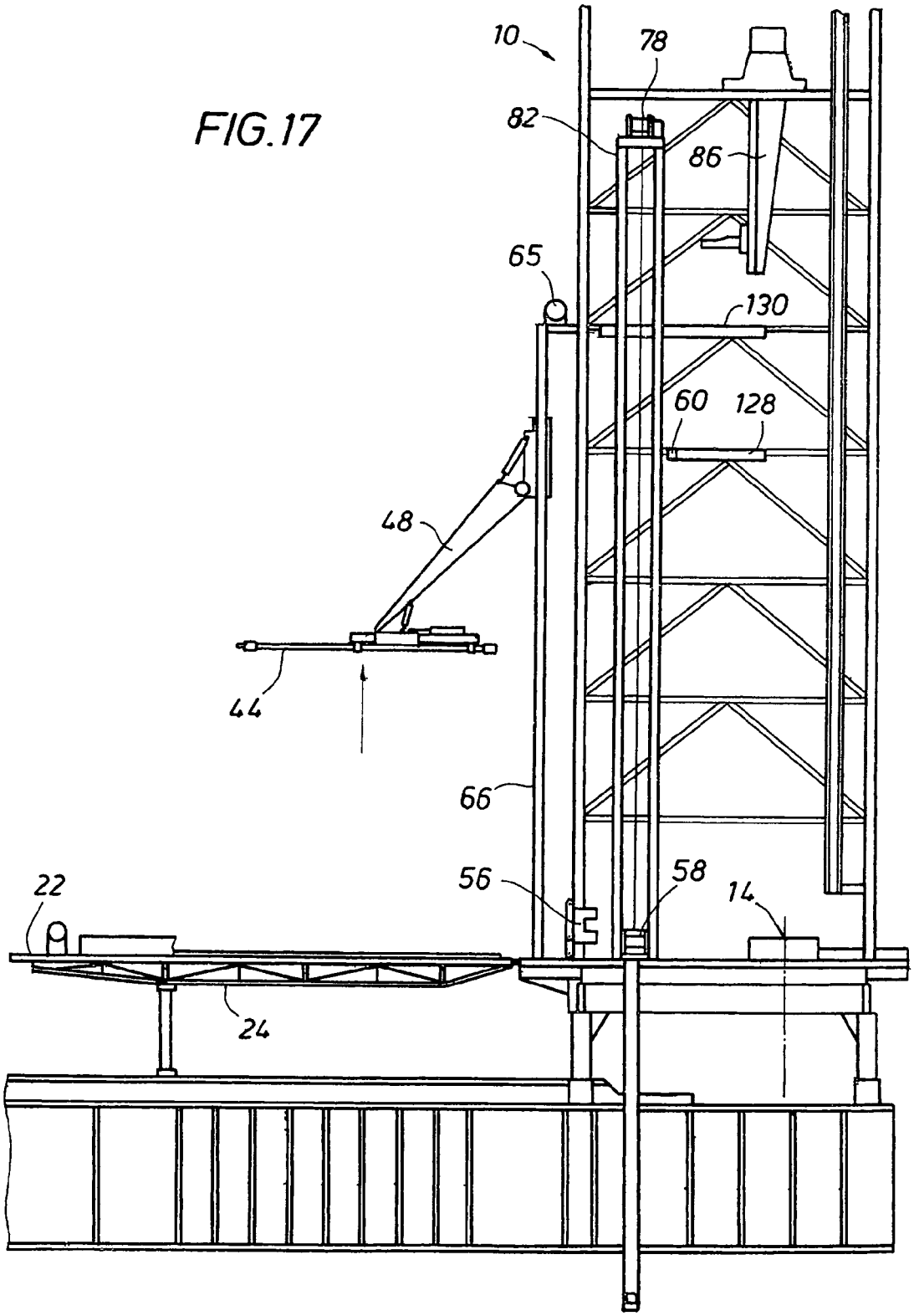
FIG. 17 is a view similar to FIG. 16 with the HTV and the tubular in the raised second horizontal position.
Figure 19:
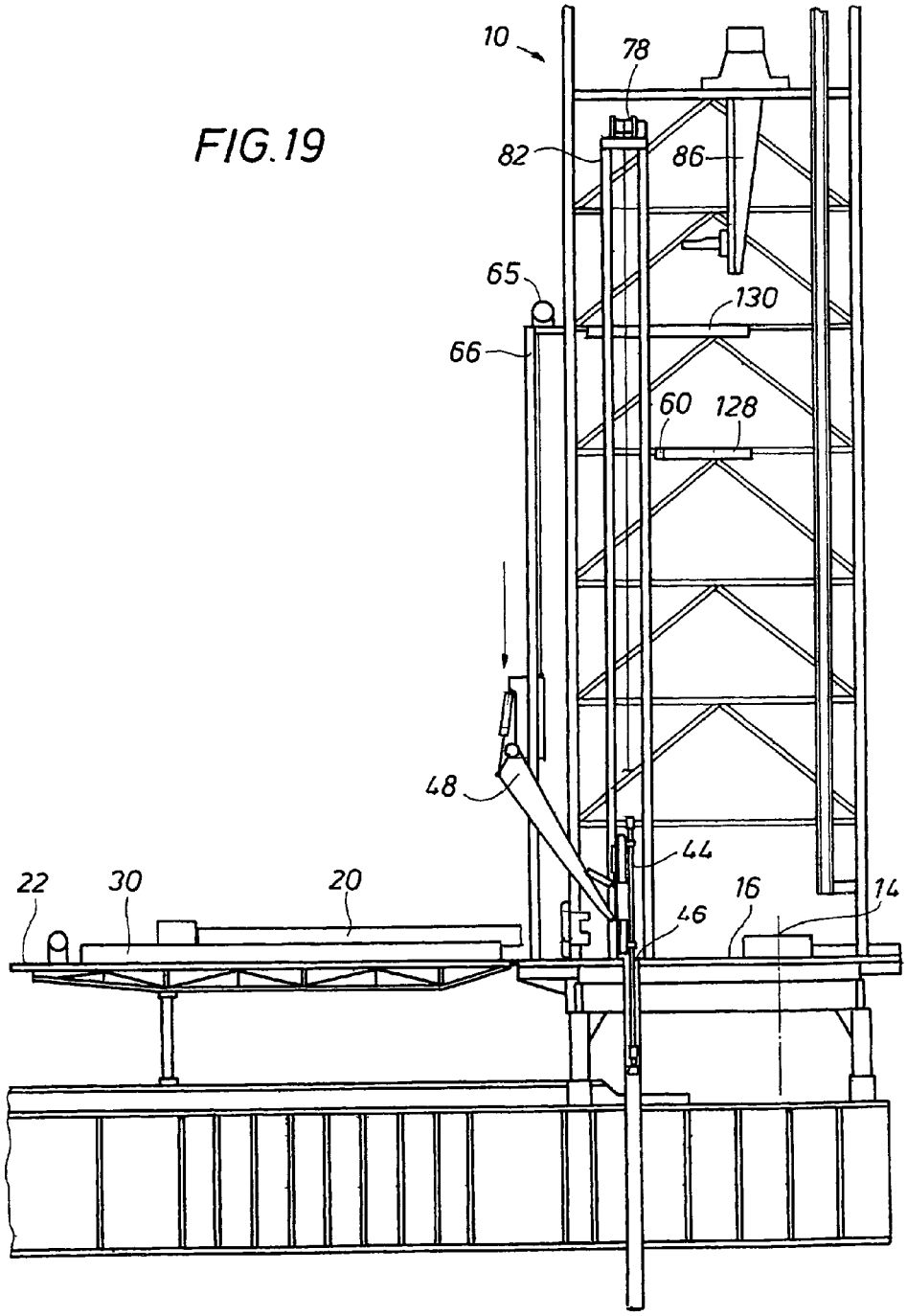
FIG. 19 is a view similar to FIG. 16 with the HTV lowering the tubular into the preparation hole while the casing section is simultaneously positioned on the online carriage.

It should also be understood that while the method of building stands of three tubulars is described below, the same method can be used for the construction of stands with other numbers of tubulars. With that understanding, according to one exemplary embodiment of the method of the invention, an offline tubular stand may be assembled in the following manner:

As shown in FIG. 16, the HTV 48 grips a single tubular 44 (referred to as the first tubular) on the pipe rack 43 on the offline side of the catwalk 22 while in the first horizontal position. The first tubular 44 is lifted straight up perpendicular to the catwalk 22 to the second horizontal position, as is shown in FIG. 17. The tubular is then rotated 90° in the same plane so that it is in vertical alignment with the preparation hole 46 (FIGS. 6 (phantom view) and 18). As shown in FIG. 19, the HTV 48 then lowers the vertical tubular 44 straight down into the preparation hole 46, where the tubular 44 is released by the HTV 48. The preparation hole 46 is adjusted so that when the tubular 44 is released, a portion of the tubular 44 remains above the drilling deck 16. The HTV 48 moves straight up vertically, and simultaneously rotates back 90° to the second horizontal position (FIG. 20). While the above actions of the HTV 48 are simultaneously occurring, the stand arm 58, which is at its lowest vertical position near the drilling deck 16 (FIG. 2A phantom view), extends to the preparation hole 46 and grips the first tubular 44. As shown in FIG. 20, the stand arm 58 lifts the tubular 44 out of the preparation hole 46 while maintaining the tubular in the vertical position. The stand arm 58 thereafter retracts and moves and/or rotates so as to move the vertical tubular out of vertical alignment with the preparation hole 46 in the area of the auxiliary tubular handling station 58 so as not to interfere with the path of the HTV 48.

Figure 21:
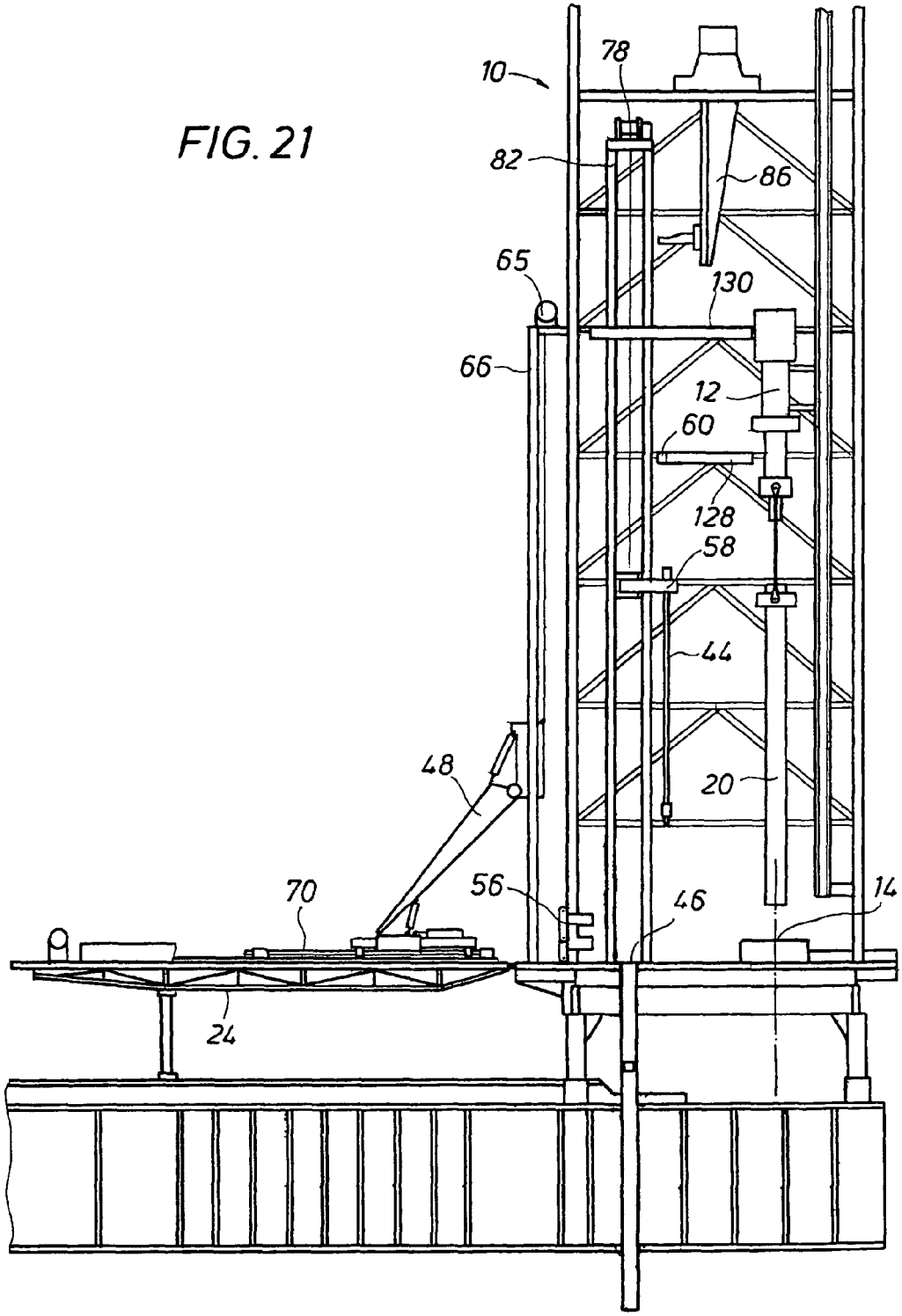
FIG. 21 is a view similar to FIG. 16 with the HTV gripping a second drill pipe section while the casing section is simultaneously being lowered by the online top drive above the well center.
Figure 22:
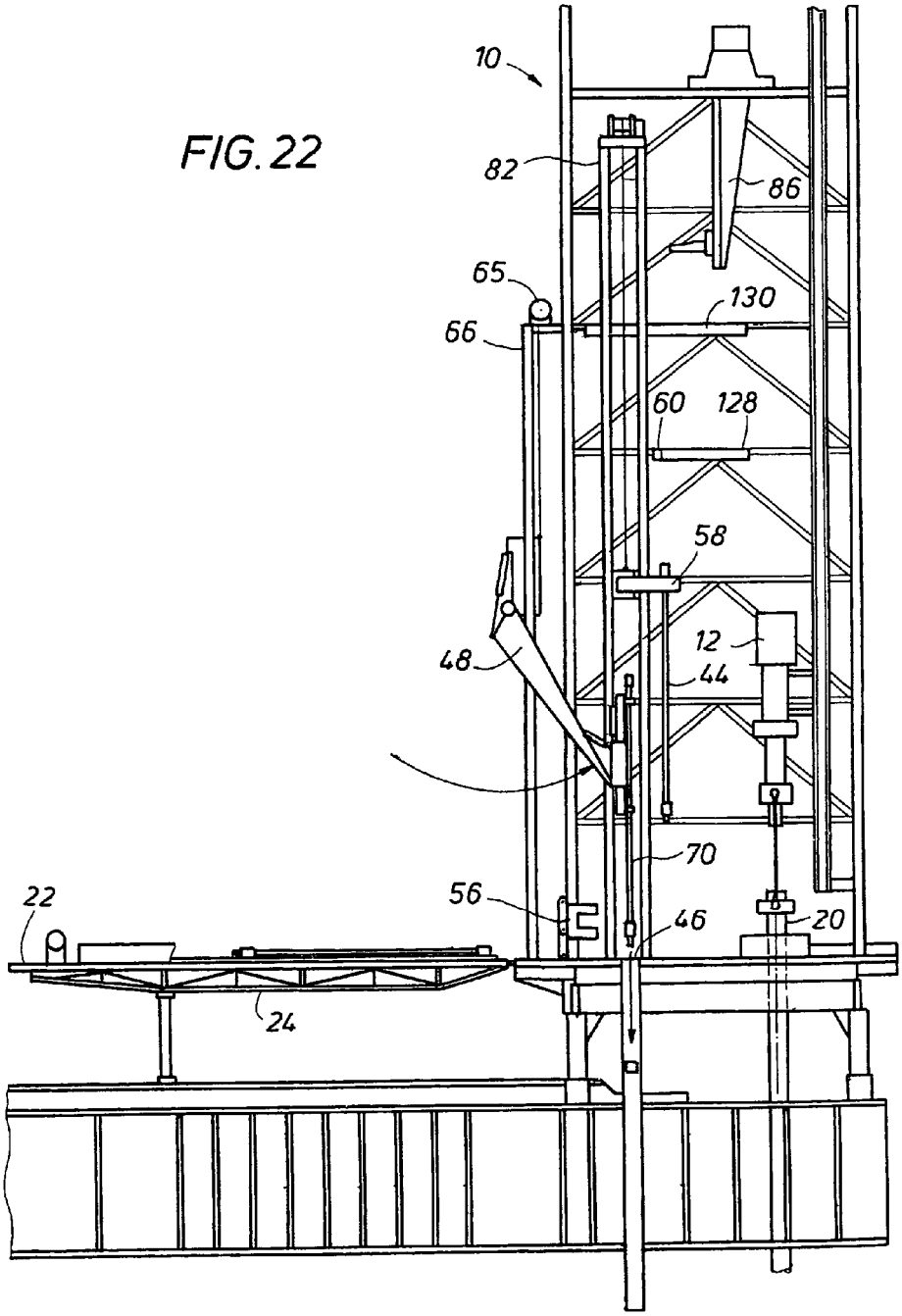
FIG. 22 is a view similar to FIG. 16 with the second drill pipe section guided into, alignment with the preparation hole while the casing section is lowered by the online top drive into the well center.
Figure 23:
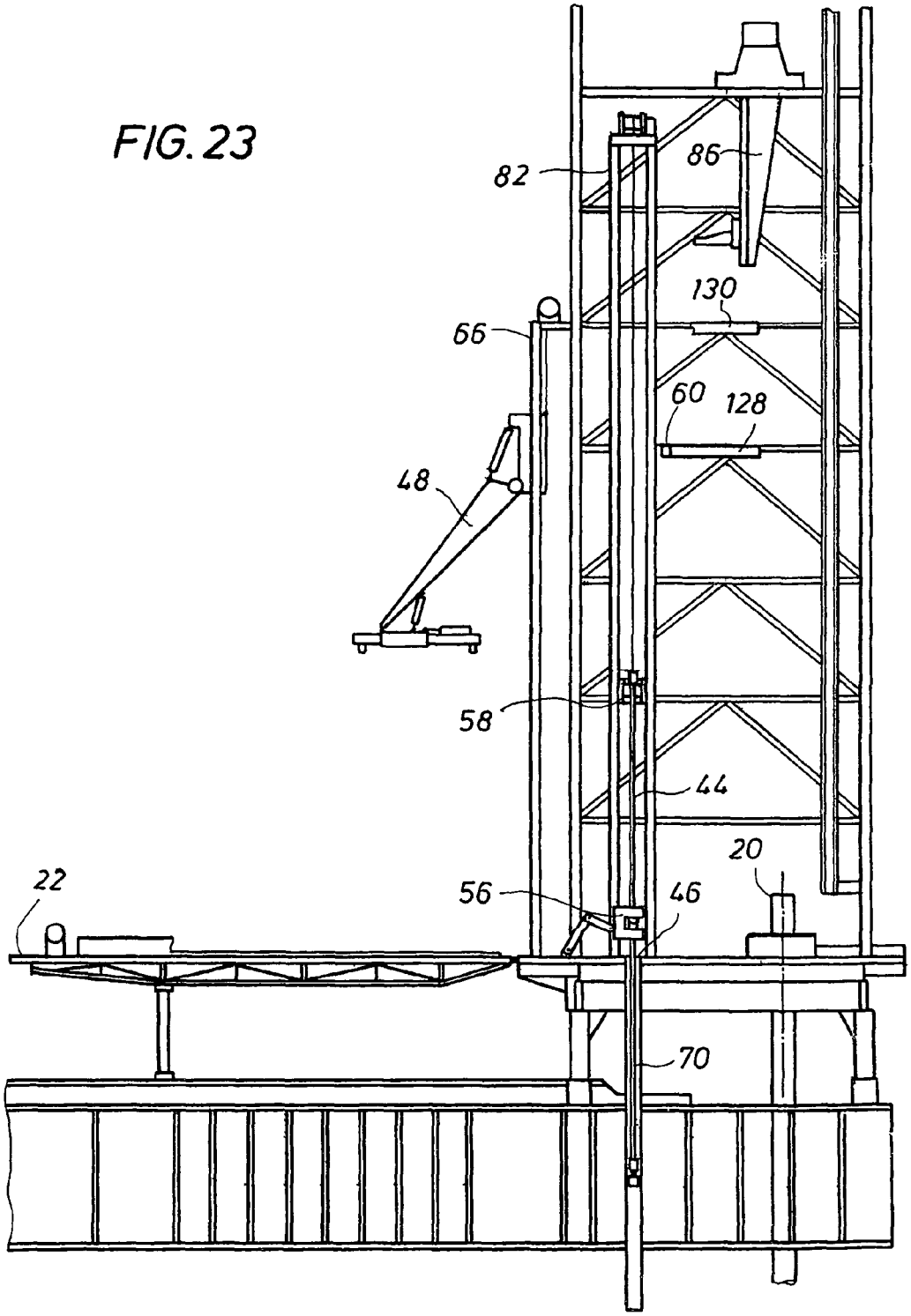
FIG. 23 is a view similar to FIG. 16 with the second drill pipe section lowered into the preparation hole and being connected with the first drill pipe section with a tubular make up device while the casing section is simultaneously lowered into the well center.
Figure 24:
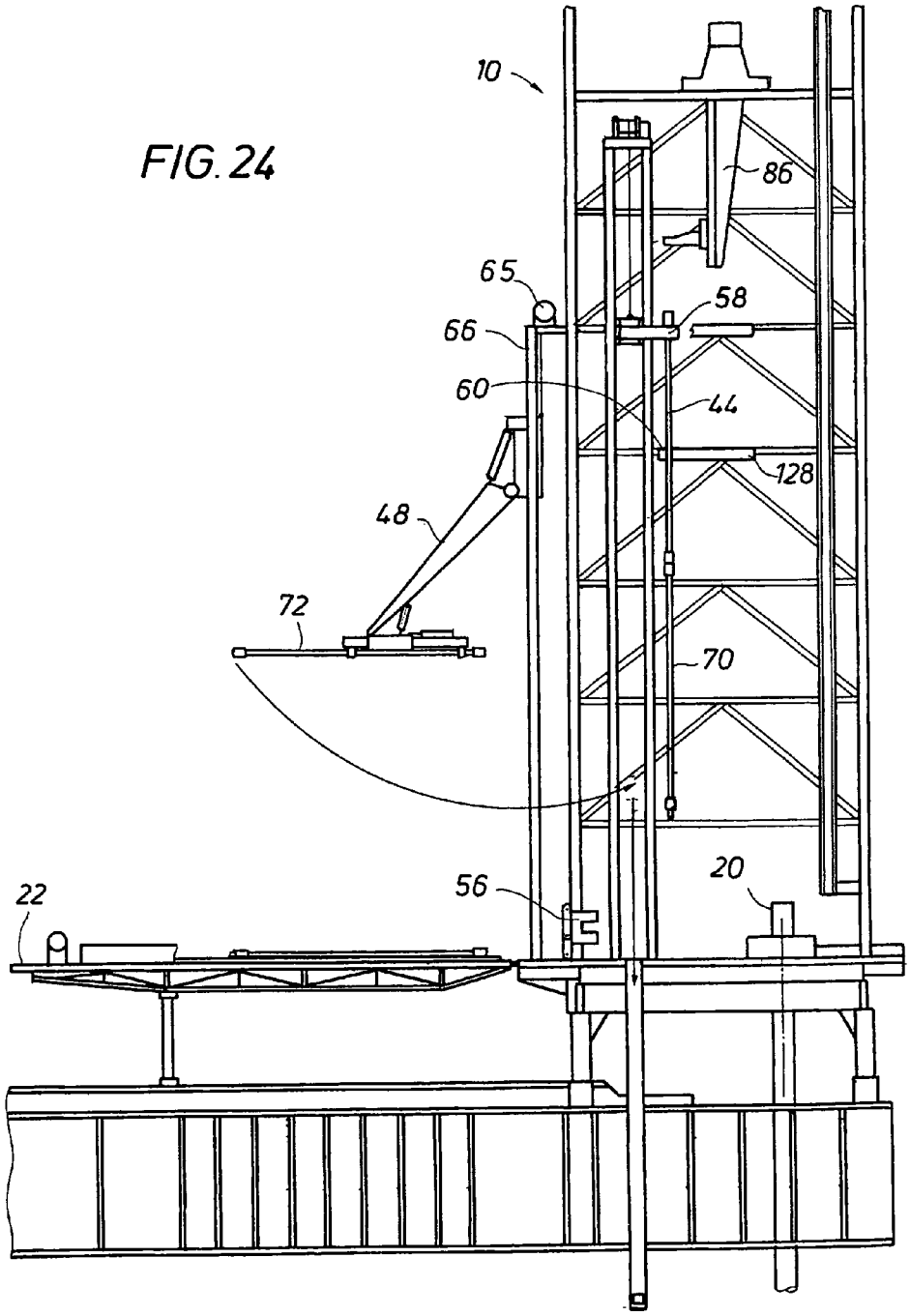
FIG. 24 is a view similar to FIG. 16 illustrating the HTV with a third drill pipe section in the raised second horizontal position before being guided into alignment with the preparation hole, the connected first and second drill pipe sections shown being lifted by the stand arm out of alignment with the preparation hole to allow the third tubular to be received into the preparation hole.
Figure 25:
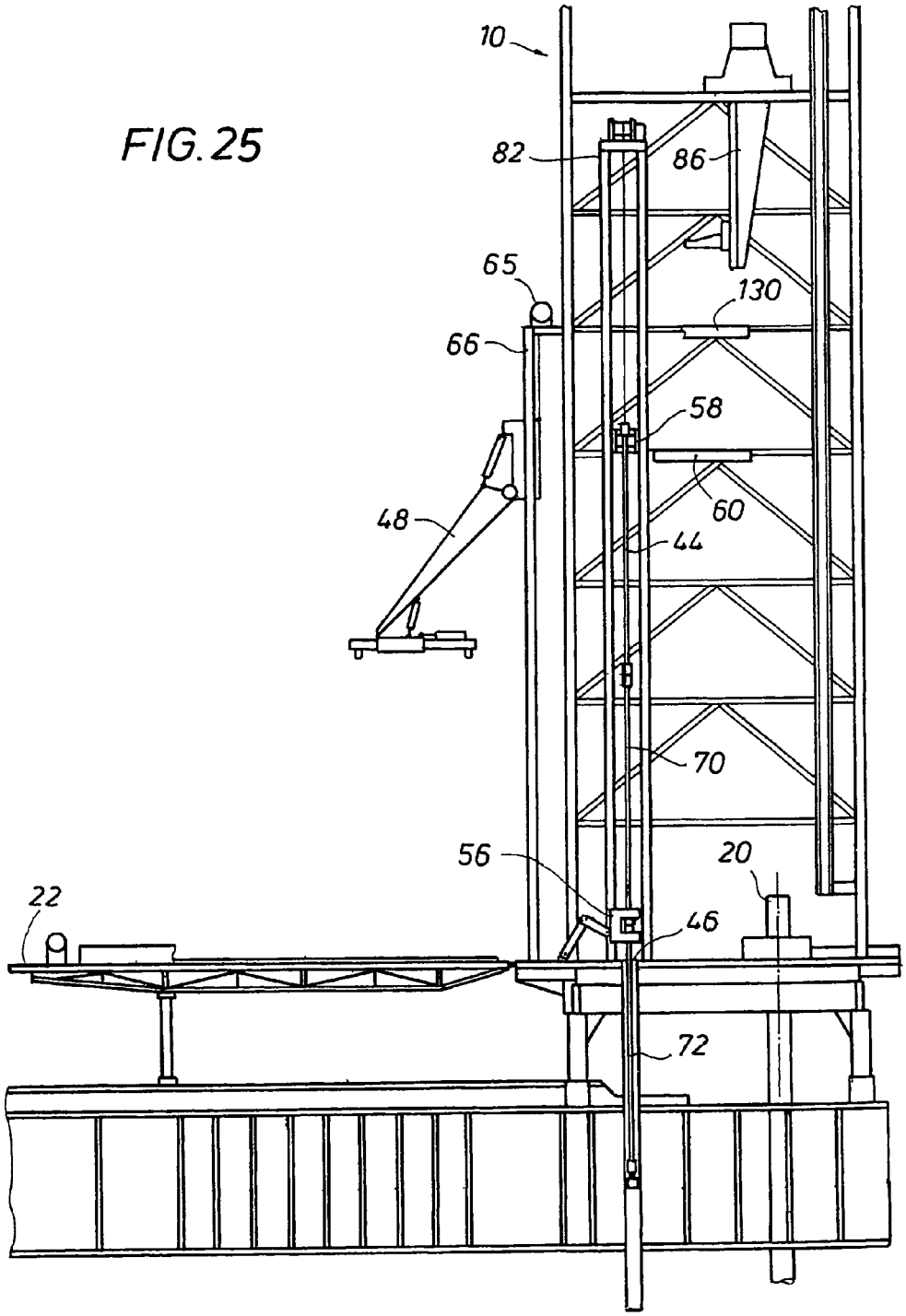
FIG. 25 is a view similar to FIG. 16 with the first and second tubulars being connected with the third tubular by the tubular make up device.

As shown in FIG. 21, the HTV 48 lowers to the first horizontal position, where it grips another single tubular 70 (referred to as the second tubular) that has been rolled into position with the indexing arm assembly 50 on the pipe rack 43 on the offline side of the catwalk 22 (FIG. 5). The HTV 48 then moves straight up to the second horizontal position, similar to the position of FIG. 20 and again rotates 90° in the same plane aligning the second tubular so that it is vertically over the preparation hole 46 (FIG. 22). The HTV 48 lowers the second tubular 70 into the preparation hole 46, and releases it. The HTV 48 then simultaneously moves straight up and rotates 90° back to the second horizontal position. As is shown in FIG. 23, simultaneously while that occurs, the stand arm 58 extends and moves or rotates back so as to vertically align the first tubular 44 over the preparation hole 46. The stand arm 58 then lowers the first tubular 44 so that the auxiliary tubular make up device 56 can connect it with the second tubular 70 (FIG. 23). The stand arm 58 then lifts the tubular stand (44, 70) out of the preparation hole 46, and again retracts and moves or rotates to move the vertical stand (44, 70) out of alignment of the HTV 48 with the preparation hole 46. As shown in FIG. 24, while the stand arm 58 is performing such operations, the HTV 48 simultaneously picks up, lifts, and rotates a third tubular 72 in the same manner as previously described. The HTV 48 lowers the third tubular 72 into the preparation hole 46, and releases it. Again, a portion of the third tubular 72 remains extended out of the preparation hole 46 above the drilling deck 16. The stand arm 58 moves the tubular stand (44, 70) back into alignment with the preparation hole 46, and lowers the stand (44, 70) over the third tubular 72 for connection by the auxiliary tubular make up device 56 (FIG. 25).

Figure 26:
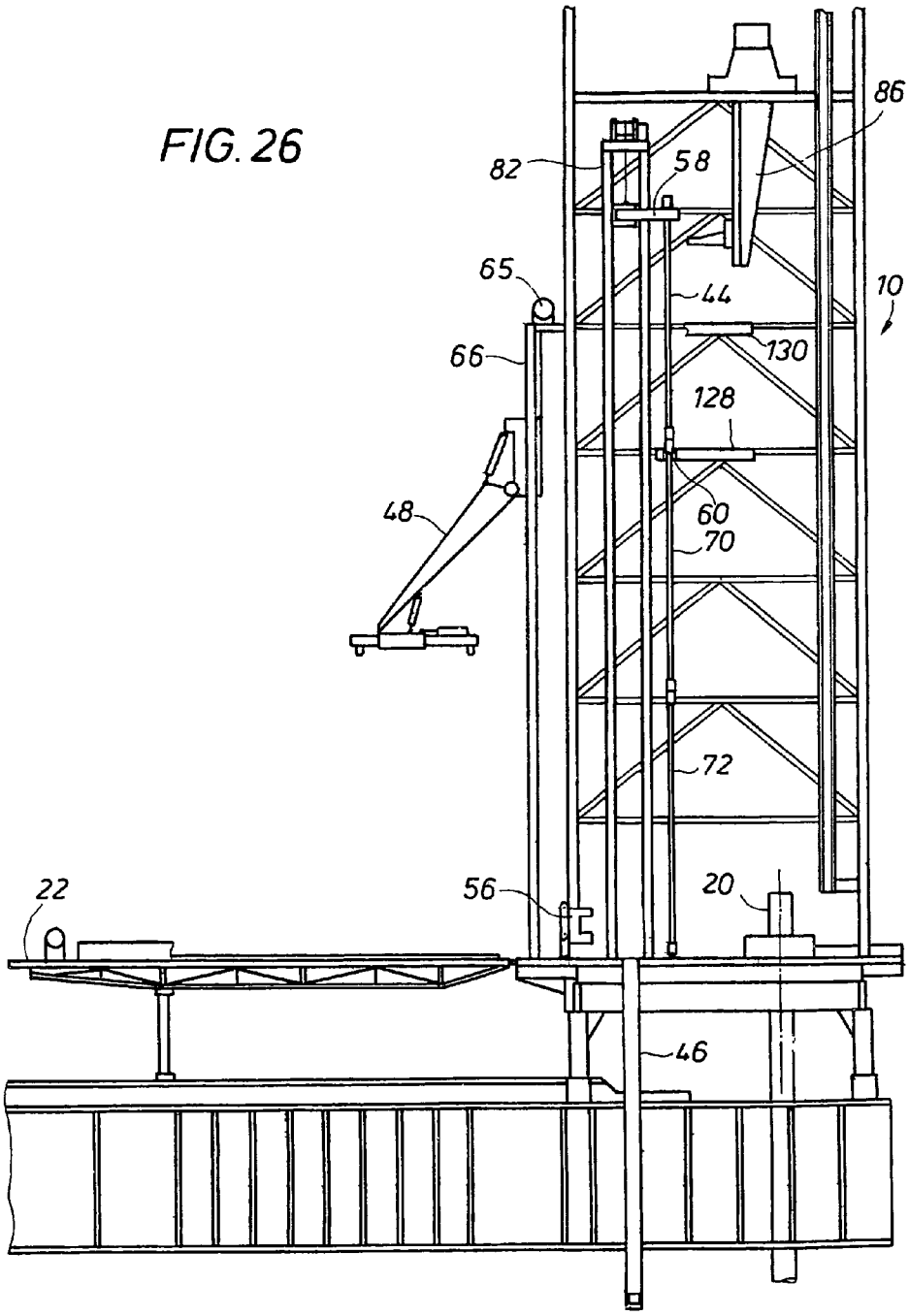
FIG. 26 is a view similar to FIG. 16 with the stand arm lifting the stand of three tubulars from the preparation hole to the auxiliary tubular racking station.

As shown in FIG. 26, the stand arm 58 lifts the completed stand (44, 70, 72) out of the preparation hole 46 and moves it in a vertical position to the auxiliary racking station 60 for placement and release. The stand arm 58 can extend and move or rotate as necessary to maneuver tubulars between the preparation hole 46 (FIG. 2A phantom view) and the auxiliary racking station 60 (FIG. 2A solid lines). While the auxiliary racking station 60 preferably has capacity for approximately 10 tubular stands, other capacities are contemplated.

Figure 27:
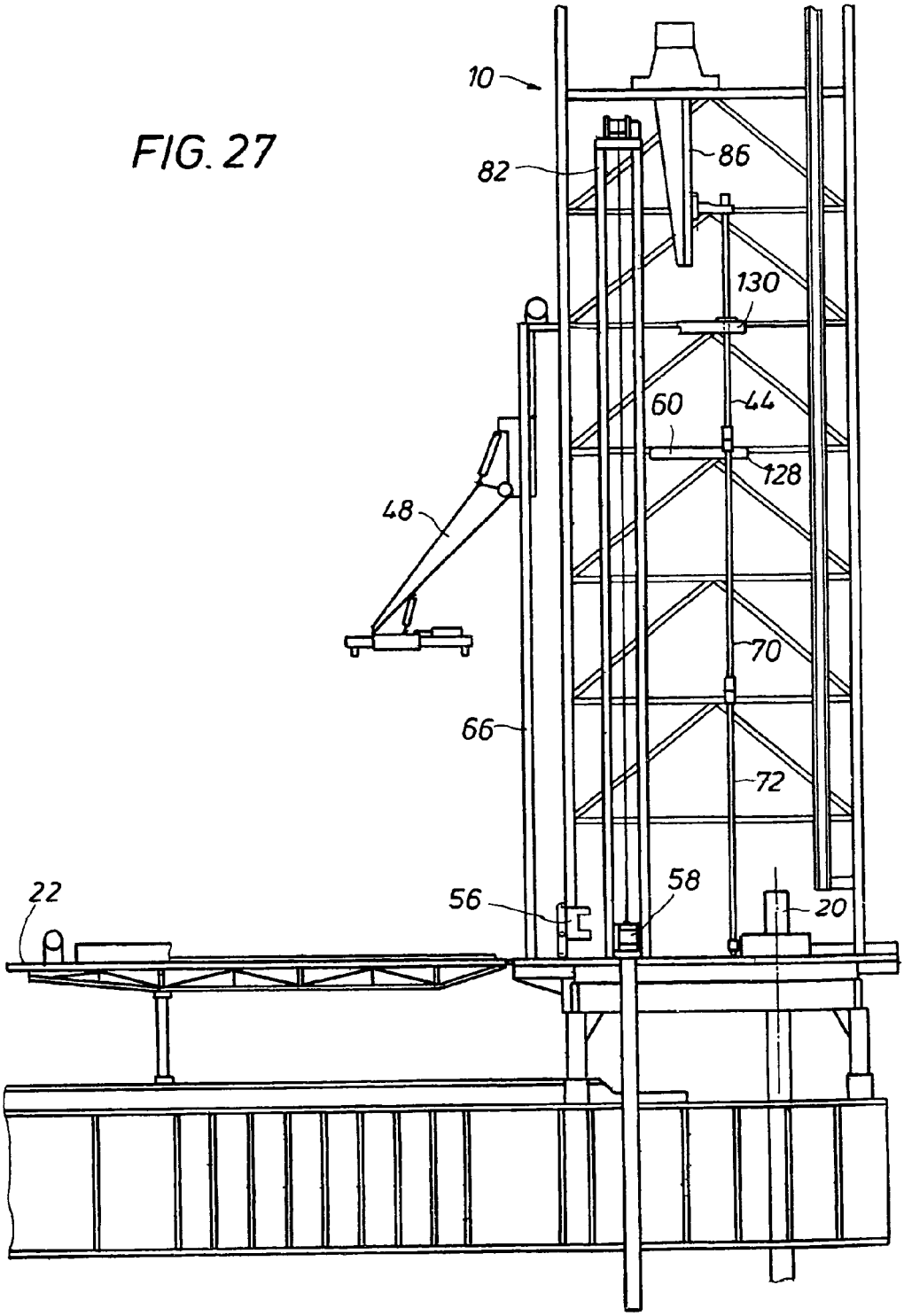
FIG. 27 is a view similar to FIG. 16 with the bridge racker crane, as shown in FIGS. 3, 4 and 8, gripping the stand of tubulars from the auxiliary tubular racking station and moving the stand to a drill pipe racking station.
Figure 28:
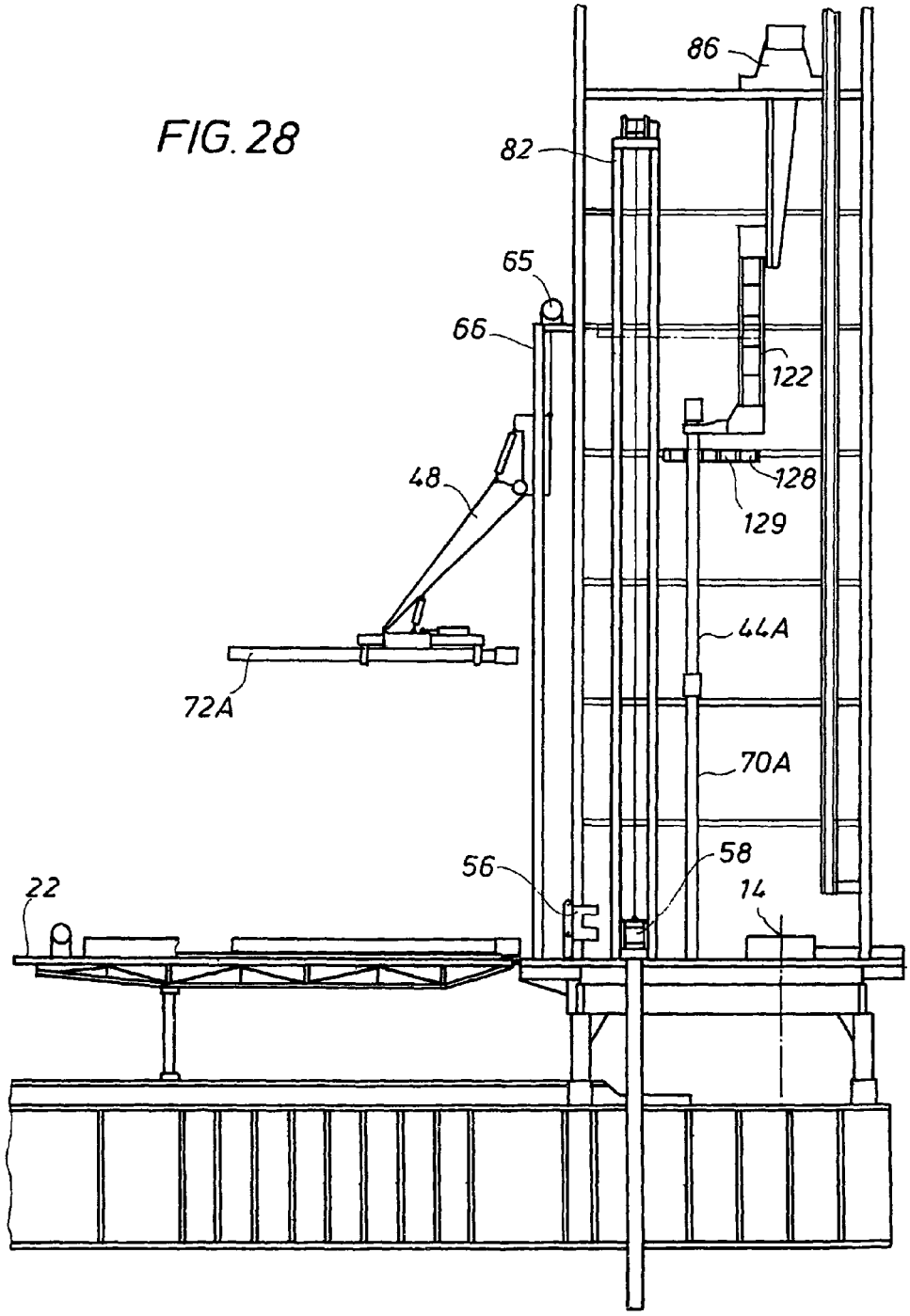
FIG. 28 is a view similar to FIG. 16 showing the HTV with a casing section in the second horizontal position while the bridge racker crane, with the casing attachment of FIG. 9, is simultaneously positioning a stand of casing in the auxiliary tubular racking station.

As shown in FIG. 27, the bridge crane 86 can remove a tubular stand (shown for illustrative purposes as a drill pipe stand (44, 70, 72) although any other stand in the station 60 could have been used) from the auxiliary racking station 60 when not performing online operations. The bridge crane 86 can move a stand to either the first 128 or second 130 tubular racking stations as appropriate and necessary, or it can move a stand directly to the top drive 12. The same operation is shown in FIG. 28 with a tubular stand (44A, 70A) of casing. The casing frame 122 is attached to the bridge crane 86 for handling casing stands that have been placed in the first tubular racking station 128. The remotely operable lances 129 are shown in end view in the first tubular racking station 128.

As can now be seen from the above, as the bridge crane 86 is being used for online operations, then the offline stand building activities can still continue uninterrupted. The bridge crane 86 is not in the critical path of the offline stand building operation. There will be occasions when the bridge crane 86 will work with either the offline or online operations, and not hinder the speed and functionality of the other operation.

Online

Figure 18:
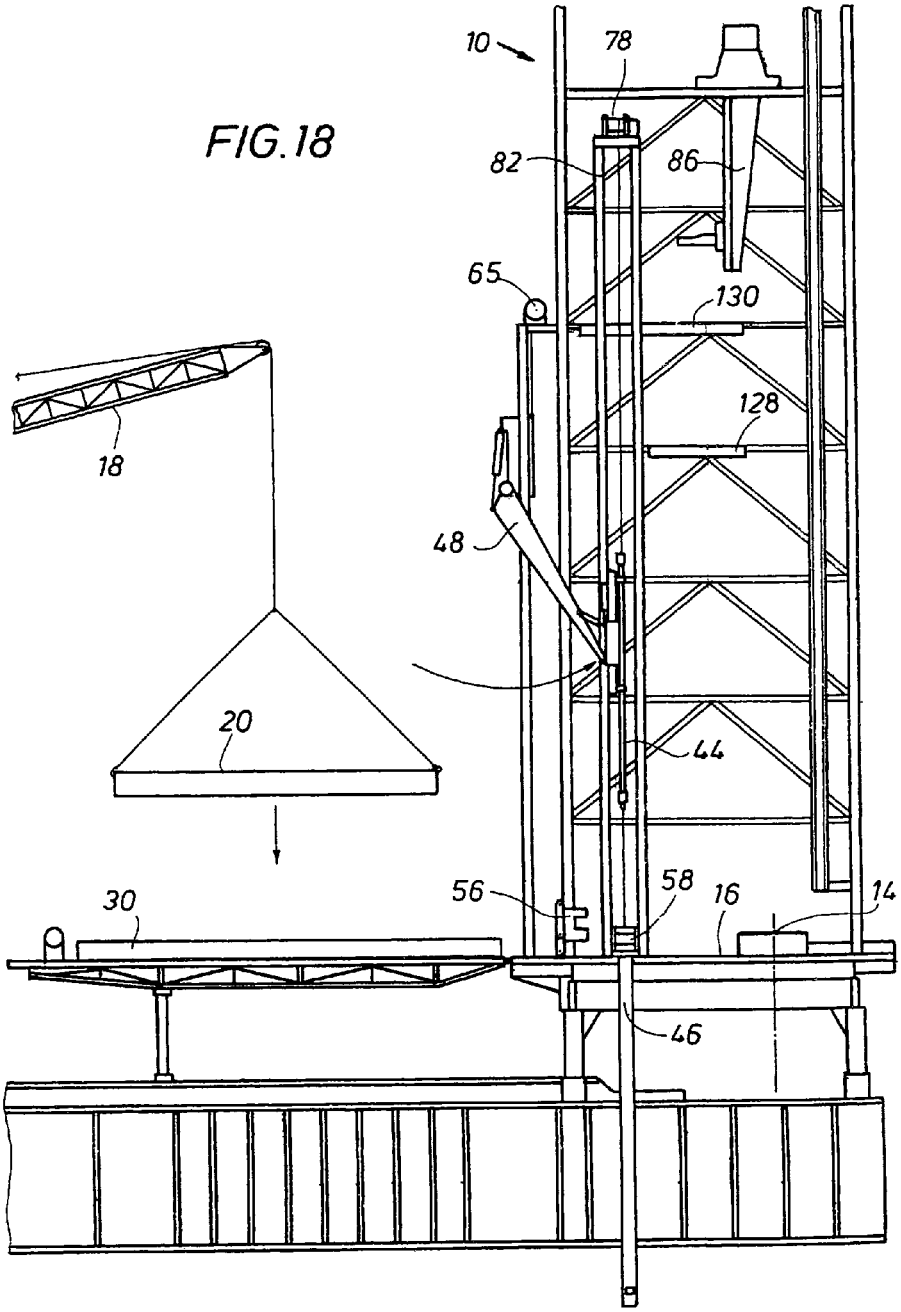
FIG. 18 is a view similar to FIG. 16 with the HTV guiding the tubular to a vertical position aligned with the preparation hole, as shown in FIGS. 10 and 11, and additionally illustrating the deck crane delivering a casing section to the online carriage for advancement to the well center.

While FIGS. 16 to 28 were described above relative to the offline operations, FIGS. 18 to 22 also illustrate how the primary or online drilling operations can proceed simultaneously with these offline operations. As shown in FIG. 18, the deck crane 18 places a tubular 20 on the carriage 30 while the offline operation is occurring. As shown in FIGS. 19 to 20, the carriage 30 moves the tubular 20 across the drilling deck 16 and toward the well center 14. The hydraulically activated front pipe lifter 39 slightly elevates the end of the tubular 20 near the well center 14, where the tubular is gripped by the top drive 12 (FIG. 20). The top drive 12 then lifts the tubular 20 to the vertical position (FIG. 21) in alignment with the well center 14, and thereafter lowers the tubular 20 (FIG. 22). The above steps can be performed again with a second tubular so that the second tubular is positioned for connection by the tubular make up device 42 with the tubular extending above the well center.

Laydown

Figure 29:
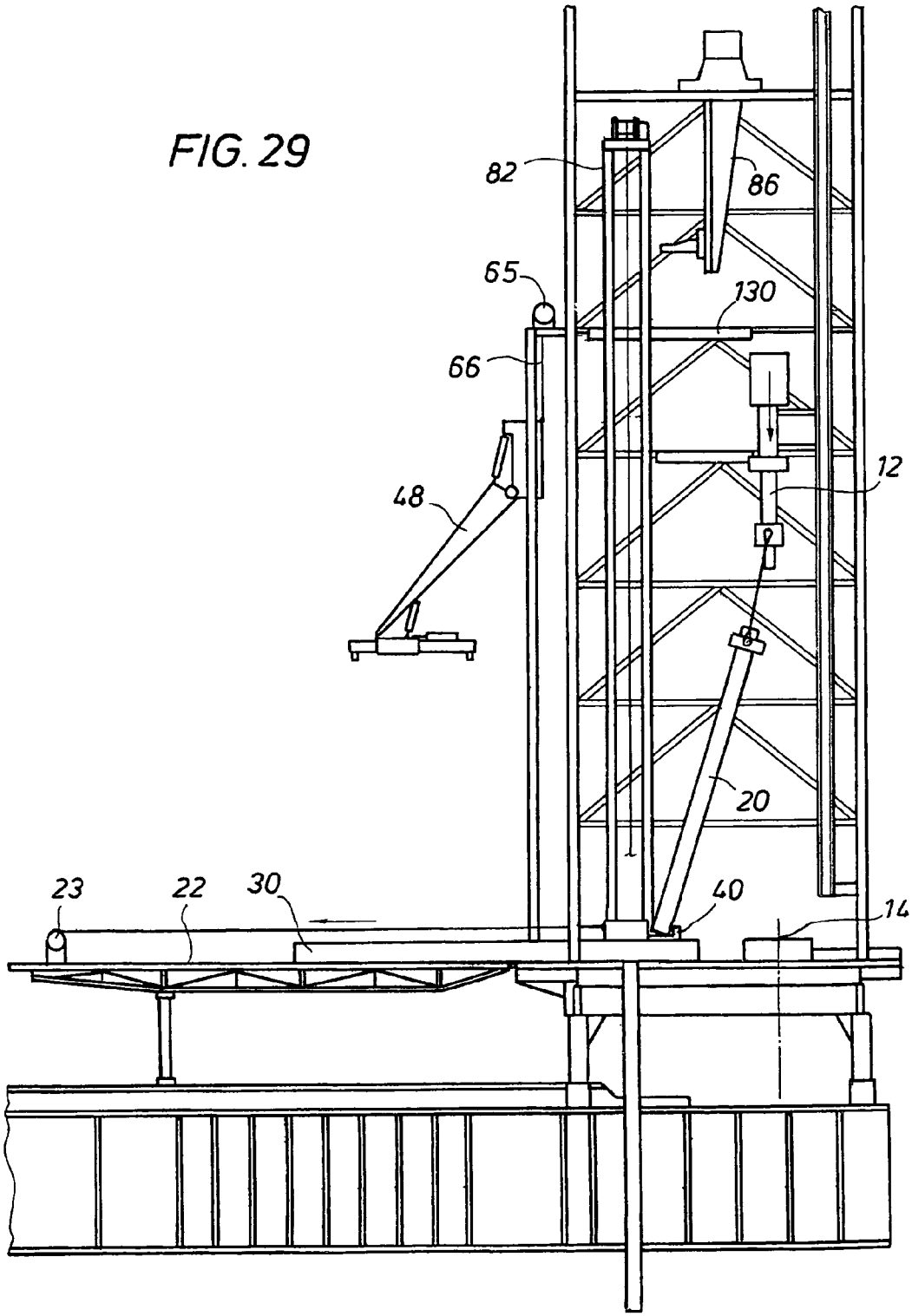
FIG. 29 is a view similar to FIG. 16 showing a casing section raised from the well center by the top drive and laid down onto the carriage, and the laydown trolley on the top of the carriage being driven in the direction of the arrow to tilt the casing section.

The online and offline operations can also be simultaneously and independently performed in reverse order from that described above for removal, disconnection, and laydown of tubulars. In the primary or online operation, the top drive 12 pulls the tubular string up through the well center 14 for the disconnection of either a single tubular or a tubular stand from the string using the tubular make up device 42. If a tubular stand is disconnected, it can then be lifted up the derrick 10 for transfer to the bridge crane 86, and transported to one of the tubular racking stations. The stands of tubulars can be simultaneously and independently disconnected and moved to the pipe rack 43 on the offline side of the catwalk 22 using the stand aim 58 and the HTV 48. If a single tubular, for example tubular 20 (FIG. 29), is disconnected, it can then be maneuvered with the top drive 12 so that the lower end of the vertical tubular 20 is placed on the laydown trolley 40 positioned at the end of the carriage 30, which carriage has been positioned near the well center 14. The carriage is then moved away from the well center 14 and back toward the catwalk 22 as shown in FIG. 29.

The foregoing disclosure and description of the invention is illustrative and explanatory thereof, and various changes in the details of the illustrated system and construction and the method of operation may be made without departing from the spirit of the invention.

We claim:

1. A system for drilling, said system comprising:

a drilling deck;

a drilling structure disposed with said drilling deck;

a primary tubular advancing station having a well center and disposed with said drilling structure for advancing a first tubular to said well center;

an auxiliary tubular handling station for handling a second tubular;

said drilling deck having a preparation hole positioned with said auxiliary tubular handling station for receiving a portion of the second tubular;

an auxiliary tubular handling device for positioning the second tubular in a substantially vertical position above said preparation hole;

an auxiliary tubular racking station above said auxiliary tubular handling station for holding the second tubular from said auxiliary tubular handling station, wherein the second tubular is positioned in a substantially vertical position above said preparation hole or held in said auxiliary tubular racking station while the first tubular is independently and simultaneously advanced through said primary tubular advancing station to said well center; and a bridge racker crane configured to move the second tubular between said auxiliary tubular racking station and said well center, wherein said auxiliary tubular handling device configured to directly position the second tubular with said auxiliary tubular racking station.

2. The system of claim 1 wherein said system further comprising:

a primary tubular racking station positioned above said primary tubular advancing station for receiving at least one tubular from said auxiliary tubular racking station.

3. The system of claim 2 wherein said bridge racker crane configured to move the second tubular between said primary tubular racking station and said auxiliary tubular racking station.

4. The system of claim 2 wherein said bridge racker crane configured to move the second tubular between said well center and said primary tubular racking station.

5. The system of claim 1 wherein said auxiliary tubular handling device comprises:

a stand arm for moving the second tubular between said preparation hole and said auxiliary tubular racking station, wherein said stand arm operable independent of said bridge racker crane.

6. The system of claim 1 wherein said auxiliary tubular handling device configured to assemble a plurality of tubulars so that the first of the plurality of tubulars moved to said preparation hole is on top of the assembled tubulars.

7. The system of claim 1 wherein said preparation hole includes a centralizer to center the second tubular with said preparation hole.

8. The system of claim 1 further comprising an hydraulic lifter to elevate the first tubular.

9. The system of claim 1 further comprising an indexing arm assembly, wherein one of the tubulars is separated by said indexing arm assembly for positioning the tubular to be moved to said drilling deck.

10. A method for moving a plurality of tubulars to a borehole from a drilling deck, said method being perfomed, at least partially, from a primary tubular advancing station and, at least partially, from an auxiliary tubular handling station, the method comprising the steps of:

(a) drilling the borehole through a well center in the drilling deck;

(b) moving a first tubular with said primary tubular advancing station to said well center in a substantially vertical first plane comprising said well center; and (c) during at least a portion of the time for performing steps (a) and (b), (i) moving a second tubular in a substantially vertical second plane so as not to intersect said first plane; (ii) positioning a portion of the second tubular in a preparation hole substantially in said second plane in the drilling deck; and (iii) lifting the second tubular to an auxiliary tubular racking station, wherein step (c) is performed independently of and during at least a portion of the same time as steps (a) and (b).

11. The method of claim 10, wherein the step of moving the second tubular includes the step of rotating the second tubular substantially in said second plane substantially parallel to said first plane.

12. The method of claim 10, further comprising the steps of:

connecting a plurality of the tubulars in said auxiliary tubular handling station; and lifting the connected tubulars from the auxiliary tubular handling station to said auxiliary tubular racking station.

13. The method of claim 12, further comprising the step of:

moving the connected tubulars from said auxiliary tubular racking station to a position substantially aligned with said well center.

14. The method of claim 12, further comprising the step of:

moving the connected tubulars from said auxiliary tubular racking station to a primary tubular racking station.

15. The method of claim 10 wherein the step of positioning a portion of the second tubular in a preparation hole comprises centering the second tubular in said preparation hole.

16. The method of claim 10 wherein the step of moving the first tubular to said well center comprises elevating the first tubular with an hydraulic lifter.

17. The method of claim 10 wherein one of the steps for moving a tubular comprises separating the tubular with an indexing arm assembly.

18. A system for drilling, said system comprising:

a drilling deck having a well center;

a drilling structure disposed with said drilling deck;

a primary tubular advancing station for advancing a first tubular from a substantially horizontal position to a substantially vertical position above said well center;

a stand arm disposed on said drilling deck for connecting a second tubular with a third tubular while the second tubular is in a substantially vertical position, wherein said stand aim is configured to operate during said primary tubular advancing station advancing the first tubular to said well center and independently of said primary tubular advancing station;

a first tubular racking station above said drilling deck for holding the second tubular from said stand arm, wherein said stand arm is configured to directly position the second tubular with said first tubular racking station; and a bridge racker crane configured to move the second tubular between said first tubular racking station and said well center.

19. The system of claim 18, further comprising a guided path horizontal to vertical arm positioned adjacent to said stand arm to guide the second tubular from a substantially horizontal position to a substantially vertical position adjacent to said stand arm, wherein said stand aim and said guided path arm are configured to operate during the primary tubular advancing station advancing the first tubular to said well center and independently of said primary tubular advancing station.

20. The system of claim 18, wherein said stand arm being operable independent of said bridge racker crane.

* * * * *